US008901406B1

(12) United States Patent
Buskies et al.

(10) Patent No.: US 8,901,406 B1
(45) Date of Patent: Dec. 2, 2014

(54) SELECTING AUDIO SAMPLES BASED ON EXCITATION STATE

(71) Applicant: Apple Inc., Cupertino, CA (US)

(72) Inventors: Christoph Buskies, Hamburg (DE); Matthias Gros, Hamburg (DE)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/965,913

(22) Filed: Aug. 13, 2013

Related U.S. Application Data

(60) Provisional application No. 61/845,780, filed on Jul. 12, 2013.

(51) Int. Cl.
*G10H 1/18* (2006.01)

(52) U.S. Cl.
USPC ..... 84/615; 84/653

(58) Field of Classification Search
USPC ..... 84/615, 653
IPC ..... G10H 1/18
See application file for complete search history.

(56) References Cited

U.S. PATENT DOCUMENTS

| | | | | |
|---|---|---|---|---|
| 5,018,430 | A * | 5/1991 | Iijima et al. | 84/625 |
| 5,319,151 | A * | 6/1994 | Shiba et al. | 84/603 |
| 5,471,008 | A * | 11/1995 | Fujita et al. | 84/633 |
| 5,726,371 | A * | 3/1998 | Shiba et al. | 84/603 |
| 5,862,063 | A * | 1/1999 | Thome et al. | 708/290 |
| 6,040,516 | A | 3/2000 | Masuda | |
| 6,162,983 | A | 12/2000 | Takahashi | |
| 6,191,350 | B1 * | 2/2001 | Okulov et al. | 84/646 |
| 7,342,166 | B2 | 3/2008 | Kay | |
| 7,826,911 | B1 | 11/2010 | Bennett | |
| 8,178,773 | B2 | 5/2012 | Riopelle | |
| 8,404,958 | B2 | 3/2013 | Shrem | |
| 2012/0186419 | A1 | 7/2012 | Roderick | |
| 2013/0087037 | A1 | 4/2013 | Dreher | |

* cited by examiner

*Primary Examiner* — David S. Warren
(74) *Attorney, Agent, or Firm* — Kilpatrick Townsend & Stockton LLP

(57) ABSTRACT

Systems and methods for selecting audio samples in response to musical stimuli are provided. In some embodiments, an audio sample can be selected based on the excitation state of an instrument. A musical stimulus can be received, and a current excitation level associated with previously received musical stimuli calculated. An audio sample can be selected for playback using the current excitation level. In some embodiments, audio samples having different velocity levels can be selected in response to repeated musical stimuli. A first instance of a musical stimulus having a first velocity level can be received, and a first audio sample corresponding to the first velocity level played back. A second instance of the musical stimulus having the first velocity level can be received, and a second audio sample corresponding to a second velocity level can be selected for playback. The first and second audio samples can have different audio characteristics.

30 Claims, 15 Drawing Sheets

SELECTING AUDIO SAMPLES BASED ON EXCITATION STATE

CROSS-REFERENCE TO RELATED APPLICATIONS

This application claims the benefit of U.S. Provisional Application No. 61/845,780, filed Jul. 12, 2013, entitled "Selecting Audio Samples in Response to Musical Stimuli," the disclosure of which is incorporated by reference herein in its entirety.

This application is also related to commonly-owned co-pending U.S. application Ser. No. 13/965,929, filed of even date herewith, entitled "Selecting Audio Samples of Varying Velocity Level," the disclosure of which is incorporated by reference herein in its entirety.

BACKGROUND

The present disclosure relates generally to audio samples and more particularly to selecting audio samples in response to musical stimuli.

Digital audio workstations (DAWs) can provide users with the ability to record, edit, and play back digital audio. For instance, many DAWs include a sampling functionality wherein a user can create a musical composition by arranging audio samples using a graphical user interface (GUI) and/or MIDI controller (e.g., a keyboard). Audio samples can simulate the sound of a real musical instrument, and thus playing back an arrangement of such audio samples can simulate a live musical performance.

In some situations, the playback of audio samples may fail to accurately simulate the experience of listening to a real musical instrument. For instance, playing a note on a musical instrument with a decaying sound pattern, such as a cymbal, piano, guitar, and the like, can result in the instrument having a certain amount of excitation. Due to this excitation, playing a subsequent note can produce a different sound pattern with greater excitation as compared to the excitation produced by the initial note played when the instrument was "at rest." The playback of audio samples corresponding to such instruments may not accurately reflect differences in the excitation state.

As another example, when the same note is played repetitively on a real musical instrument, the resulting sound pattern will include some variation in audio characteristics for each repeated note, such as timbral and tonal differences. The repeated playback of an audio sample to simulate repetitive notes may sound artificial to a listener due to the lack of variation in such audio characteristics.

SUMMARY

Certain embodiments of the invention are directed to selecting audio samples in response to musical stimuli.

Certain embodiments are described that provide for selecting an audio sample based on the excitation state of an instrument. In some embodiments, a musical stimulus can be received by a computing device. The musical stimulus may correspond to a musical instrument that produces a decaying audio pattern. A current excitation level associated with previously received stimuli can be calculated. An audio sample corresponding to the received musical stimulus can be selected, the audio sample being selected using the current excitation level associated with the previously received musical stimuli. The selected audio sample can be played back.

In some embodiments, the selected audio sample can be one of a plurality of audio samples corresponding to the received musical stimulus, the plurality of audio samples corresponding to different excitation levels. In some embodiments, a velocity level of the received musical stimulus can be determined, and the plurality of audio samples (including the selected sample) may correspond to the determined velocity level.

In some embodiments, the current excitation level associated with the previously received stimuli can be compared with threshold levels assigned to the plurality of audio samples. In such embodiments, selecting the audio sample can include determining that the current excitation level exceeds a threshold level assigned to the selected audio sample.

In some embodiments, calculating the current excitation level may include determining individual excitation levels associated with the previously received stimuli, and summing the individual excitation levels to generate the current excitation level. In some embodiments, the individual excitation levels can be determined based upon the individual volume levels of the previously received musical stimuli.

In some embodiments, the received musical stimulus can be a first musical stimulus and the selected audio sample a first audio sample. The first musical stimulus can be identified as a previously received musical stimulus, and a second musical stimulus can be received. A current excitation level associated with the previously received musical stimuli including the first musical stimulus can be calculated. A second audio sample corresponding to the received second musical stimulus can be selected, the second audio sample being selected using the current excitation level associated with the previously received musical stimuli including the first musical stimulus. The selected second audio sample can be played back. In some embodiments, the second audio sample can correspond to a different excitation level than the first audio sample. In some embodiments, playback of the first audio sample can be ended when the playback of the second audio sample is initiated.

Certain embodiments are further described that provide for selecting audio samples having different velocity levels in response to repeated musical stimuli. In some embodiments, a first instance of a musical stimulus having a first velocity can be received by a computing device. A first audio sample corresponding to the first velocity level of the received musical stimulus can be played back. The first audio sample can be one of a plurality of audio samples that correspond to different velocity levels of the musical stimulus. A second instance of the musical stimulus having the first velocity level can be received. A second audio sample corresponding to a second velocity level of the received musical stimulus can be selected from the plurality of audio samples. The second audio sample can be played back, and may include different audio characteristics than the first audio sample. In some embodiments, the different audio characteristics can include different tonal characteristics.

In some embodiments, the first velocity level can correspond to a first volume level and the second velocity level can correspond to a second volume level. In such embodiments, playing back the second audio sample can include modifying the second volume level. In some embodiments, modifying the second volume level can include scaling the second volume level in accordance with the first volume level. In some embodiments, the first and second velocity levels can be adjacent velocity levels.

In some embodiments, it can be determined that the first and second instances of the musical stimulus are received consecutively. In some embodiments, a time interval between the first and second instances of the musical stimulus can be measured and compared to a threshold time interval. The measured time interval can be determined to be within the threshold time interval.

DETAILED DESCRIPTION

Figure 1:
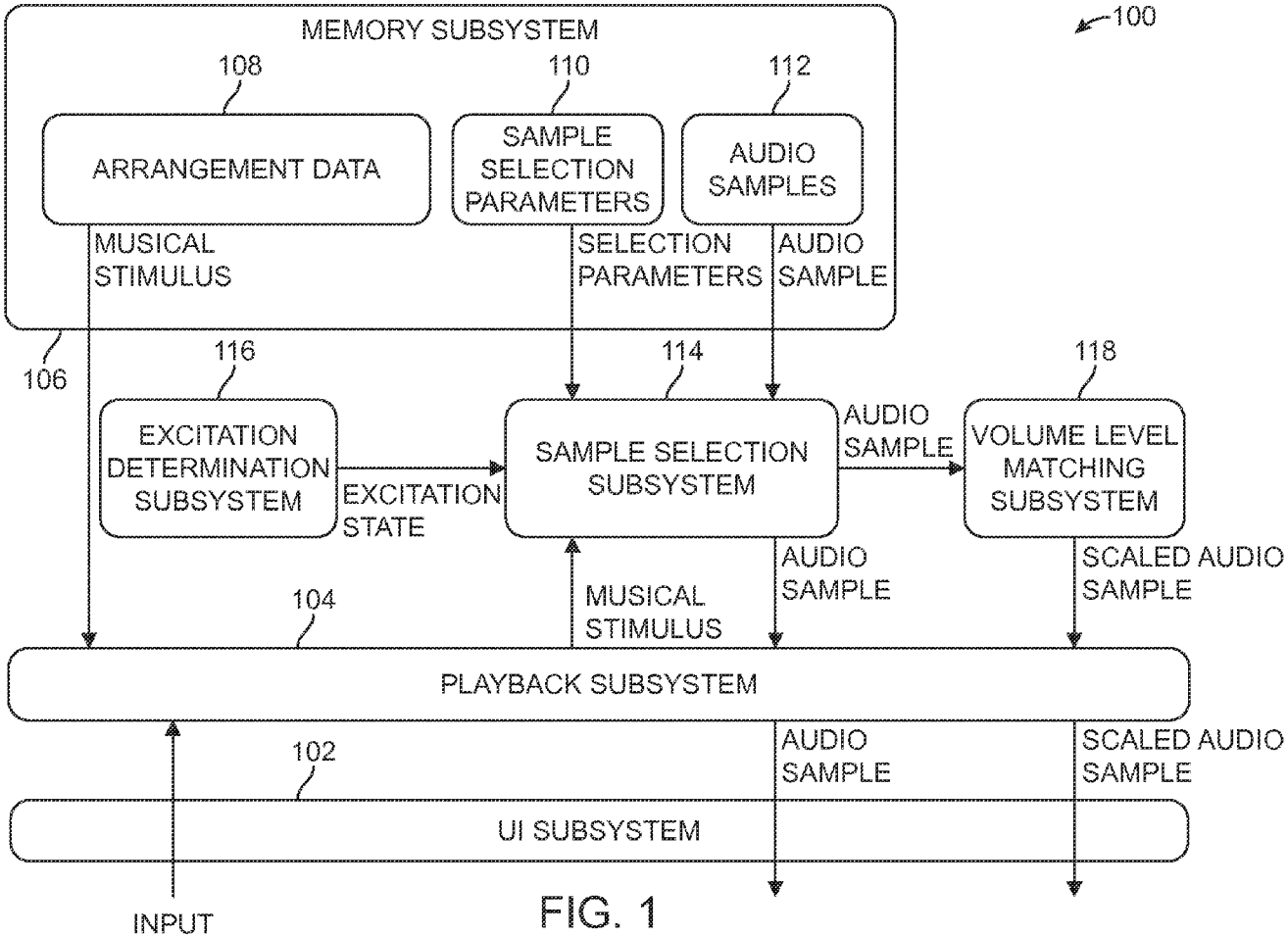
FIG. 1 illustrates a simplified diagram of a system that may incorporate one or more embodiments.

In the following description, for the purposes of explanation, specific details are set forth in order to provide a thorough understanding of embodiments of the invention. However, it will be apparent that various embodiments may be practiced without these specific details.

Certain embodiments of the invention are directed to selecting audio samples in response to musical stimuli. For instance, certain embodiments are described that provide for selecting an audio sample based on the excitation state of an instrument. As a non-liming example, audio samples corresponding to an instrument (e.g., a cymbal) can be recorded at various excitation levels. For instance, samples can be recorded of a cymbal being hit at rest, a cymbal being hit following two previous hits, a cymbal being hit following four previous hits, etc. Such samples can be recorded and stored for multiple velocity levels of the simulated instrument. When a sequence of musical stimuli is received in the context of a DAW arrangement and/or from a MIDI controller, the corresponding excitation state of the instrument can be calculated. For instance, if a musical stimulus for an instrument (e.g., a cymbal hit) is received when one or more previously received stimuli for the instrument (e.g., previous cymbal hits) are currently being played back, the individual excitation levels of the previously received stimuli can be summed. In some embodiments, the sum of the current excitation levels can be approximated by summing the individual volume levels of the previously received stimuli. Using the calculated excitation level and the intensity (e.g., the velocity level) of the instant musical stimulus, an audio sample can be selected for the instant musical stimulus that reflects the current excitation state of the simulated instrument.

In embodiments of the invention, audio samples selected based on the excitation state of an instrument may correspond to any simulated instrument capable of excitation. For instance, exemplary instruments can include a drum kit including various pieces or components (e.g., a ride cymbal, crash cymbal, hi-hat, bass drum, one or more toms, snare, etc.), other percussion instruments (e.g., a gong, bell, etc.), a stringed instrument (e.g., a guitar, bass, piano, etc.), or any other suitable instrument capable of excitation.

By storing audio samples of varying excitation levels, calculating the current excitation state of a simulated instrument, and selecting an audio sample accordingly, the excitation behavior of a real instrument can be reproduced. Thus, a more natural sounding and realistic simulation of a live performance using a real musical instrument can be provided.

Certain embodiments are further described that provide for selecting audio samples having different velocity levels in response to repeated musical stimuli. As a non-limiting example, audios samples corresponding to an instrument (e.g., a guitar) playing a particular note can be recorded at various "velocity" levels (e.g., the speed or force with which a note has been struck). When a musical stimulus is received (e.g., a guitar note with a particular velocity) in the context of a DAW arrangement and/or from a MIDI controller, an audio sample corresponding to the velocity level of the guitar can be selected and played back. If the same musical stimulus is received again (e.g., a repetition of the guitar note with the same velocity), in some embodiments, an audio sample corresponding to a different velocity level (e.g., the next higher or lower velocity) can be selected and played back.

Since audio samples corresponding to different velocity levels may be associated with different output volume levels, in some embodiments, the output volume level of the second audio sample can be scaled up or down to "match" the volume level of the first audio sample. In embodiments of the invention, audio samples selected in response to repeated musical stimuli may correspond to any suitable musical instrument.

Audio samples corresponding to different velocity levels may include differences in tone and/or timbre. Thus, by selecting audio samples for playback with different velocity levels, variations can be introduced into an arrangement or performance in which repeated notes are played. Such variation may provide for a more natural sounding and realistic simulation of a live performance using a real musical instrument.

FIG. 1 illustrates a simplified diagram of a system 100 that may incorporate one or more embodiments of the invention. In the embodiment depicted in FIG. 1, system 100 includes multiple subsystems including a user interaction (UI) subsystem 102, a playback subsystem (104), a memory subsystem 106 that stores arrangement data 108, sample selection parameters 110, and audio samples 112, a sample selection subsystem 114, an excitation determination subsystem 116, and a volume level matching subsystem 118. One or more communication paths may be provided enabling one or more of the subsystems to communicate with and exchange data with one another. One or more of the subsystems depicted in FIG. 1 may be implemented in software, in hardware, or combinations thereof. In some embodiments, the software may be stored on a transitory or non-transitory medium and executed by one or more processors of system 100.

It should be appreciated that system 100 depicted in FIG. 1 may have other components than those depicted in FIG. 1. Further, the embodiment shown in FIG. 1 is only one example of a system that may incorporate one or more embodiments of the invention. In some other embodiments, system 100 may have more or fewer components than shown in FIG. 1, may combine two or more components, or may have a different configuration or arrangement of components. In some embodiments, system 100 may be part of a computing device. For instance, system 100 may be part of a desktop computer. In some embodiments, system 100 can be part of a mobile computing device such as a laptop computer, tablet computer, smart phone, media player, or the like.

UI subsystem 102 may provide an interface that allows a user to interact with system 100. UI subsystem 102 may output information to the user. For instance, UI subsystem 102 may include a display device such as a monitor or a screen, and an audio output device such as a speaker. UI subsystem 102 may also enable the user to provide inputs to system 100. In some embodiments, UI subsystem 102 may include a touch-sensitive interface (i.e. a touchscreen) that can both display information to a user and also receive inputs from the user. For instance, in some embodiments, UI subsystem 102 can receive touch input from a user. Such touch input may correspond to one or more gestures, such as a drag, swipe, pinch, flick, single-tap, double-tap, rotation, multi-touch gesture, and/or the like. In some embodiments, UI subsystem 102 may include one or more input devices that allow a user to provide inputs to system 100 such as, without limitation, a mouse, a pointer, a keyboard, or other input device. In certain embodiments, UI subsystem 102 may further include a microphone (e.g., an integrated microphone or an external microphone communicatively coupled to system 100) and voice recognition circuitry configured to facilitate audio-to-text translation and to translate audio input provided by the user into commands that cause system 100 to perform various functions. In some embodiments, UI subsystem 102 may further include eye gaze circuitry configured to translate eye gaze input provided by the user into commands that cause system 100 to perform various functions.

Memory subsystem 106 may be configured to store data and instructions used by some embodiments of the invention. In some embodiments, memory subsystem 106 may include volatile memory such as random access memory or RAM (sometimes referred to as system memory). Instructions or code or programs that are executed by one or more processors of system 100 may be stored in the RAM. Memory subsystem 106 may also include non-volatile memory such as one or more storage disks or devices, flash memory, or other non-volatile memory devices. In some embodiments, memory subsystem 106 can store arrangement data 108, sample selection parameters 110, and audio samples 112.

Audio samples 112 stored in memory subsystem 106 can correspond to one or more simulated musical instruments. In some embodiments, one or more of audio samples 112 can be a digital recording of a real instrument being played live. Audio samples 112 can be in any suitable audio format. For instance, in embodiments of the invention, one or more of audio samples 112 can be in an uncompressed format (e.g., AIFF, WAV, AU, etc.), lossless compression format (e.g., M4A, MPEG-4 SLS, WMA Lossless, etc.), lossy compression format (e.g., MP3, AAC, WMA lossy, etc.), or any other suitable audio format.

Arrangement data 108 stored in memory subsystem 106 can describe arrangements including one or more of audio samples 112. For instance, in some embodiments, a user can create a musical arrangement by arranging a plurality of audio samples 112 within various tracks or channels using a graphical user interface (GUI) associated with a DAW executed by system 100. Arrangement data 108 can identify which of audio samples 112 are included in an arrangement. In some embodiments, arrangement data 112 can further identify the tracks and temporal positions (e.g., zones) to which audio samples have been assigned within the arrangement, relationships between audio samples (e.g., groupings of drum kit components), effects applied to audio samples in the arrangement (e.g., reverb, chorus, compression, distortion, filtering, etc.), and other parameters of audio samples include in the arrangement, such as velocity, volume level, pitch, octave, and the like.

In some embodiments, system 100 may include an interface (not shown) to communicate with an external controller (e.g., a MIDI controller). For instance, such a controller can be used to trigger the playback of one or more of audio samples 112 and/or to arrange one or more of audio samples 112 in an arrangement. In such embodiments, the arrangement and/or a record of the triggered audio samples can be stored in arrangement data 108.

Sample selection parameters 110 can include various parameters used to select one or more of audio sample 112 for playback. For instance, in the case of musical stimuli corresponding to a simulated instrument capable of excitation, in some embodiments, sample selection parameters 110 can include one or more threshold values used to select an audio sample corresponding to a particular excitation for playback. In some further embodiments, in the case of repeated musical stimuli, sample selection parameters 110 can include one or more rules regarding the selection of audio samples corresponding to varying velocity levels, threshold values used to determine whether velocity variations are to be introduced, and other parameters used for audio sample selection.

In some embodiments, system 100 may be part of a computing device. For instance, the computing device can be a desktop computer or a mobile computing device such as a laptop computer, tablet computer, smart phone, media player, and the like. In some embodiments, memory subsystem 106 may be part of the computing device. In some other embodiments, all or part of memory subsystem 106 may be part of one or more remote server computers (e.g., web-based servers accessible via the Internet or other network).

In some embodiments, UI subsystem 102, playback subsystem 104, memory subsystem 106, sample selection subsystem 114, and excitation determination subsystem 116, working in cooperation, may be responsible for selecting an audio sample for playback based on the excitation state of an instrument. For instance, input provided by a user can be received at playback subsystem 104 from UI subsystem 102. In some embodiments, the input may correspond to an instruction to playback an arrangement of audio samples.

Upon receipt of the input, playback subsystem 104 can begin playing back the arrangement of audio samples in accordance with arrangement data 108 stored in memory subsystem 106. During the playback, musical stimuli can be received (e.g., within the arrangement and/or from an external controller) that corresponds to a simulated instrument capable of excitation. For instance, the particular arrangement stored in arrangement data 108 may include a drum track including a number of cymbal notes. When an audio sample corresponding to a cymbal note is reached during playback of the arrangement, sample selection subsystem 114, working in cooperation with excitation determination subsystem 116, can select an audio sample having the appropriate excitation for playback. For instance, excitation subsystem 116 can calculate the current excitation level of the simulated instrument (e.g., the cymbal) which can be used to identify the appropriate sample for playback.

In some embodiments, to determine the current excitation state or the instrument, excitation determination subsystem 116 can calculate the current excitation level associated with previously received musical stimuli corresponding to the instrument. For instance, if there are one or more currently playing audio samples that correspond to previously received stimuli (e.g., previous cymbal notes), excitation determination subsystem 116 can sum the individual excitation levels of each stimuli. In some embodiments, the sum of the individual excitation levels can be approximated by summing the individual volume levels of the currently playing audio samples.

Sample selection subsystem 114 can use the current excitation level calculated by excitation determination subsystem 116 in combination with selection parameters stored in sample selection parameters 110 to select the appropriate audio sample for playback. For instance, in some embodiments, sample selection subsystem 114 can compare the current excitation level of the instrument with threshold values stored in sample selection parameters 110. The threshold values can correspond to audio samples having different excitation levels as stored in audio samples 112. In some embodiments, sample selection parameters 110 may include a distinct set of threshold values for audios samples corresponding to one or more velocity levels of the instrument. Thus, in such embodiments, sample selection subsystem 114 can retrieve the threshold values that specifically correspond to the velocity level of the received musical stimulus (e.g., the velocity of the cymbal note) from sample selection parameters 110. In some embodiments, sample selection subsystem 114 can analyze the threshold values to determine which, if any, of the threshold values are exceeded by (or, in some embodiments, equal to) the calculated excitation level of the instrument. In some embodiments, sample selection subsystem can select an audio sample that corresponds to the highest threshold level that is exceeded (or met) by the current excitation level of the instrument.

Sample selection subsystem 114 can retrieve the selected audio sample from audio samples 112 stored in memory subsystem 106. Playback subsystem 104 can then utilize an audio output device (e.g., a speaker) of UI subsystem 102 to playback the selected audio sample corresponding to the simulated excitation level.

In some embodiments, UI subsystem 102, playback subsystem 104, memory subsystem 106, sample selection subsystem 114, and volume level matching subsystem 118, working in cooperation, may be responsible for selecting audio samples corresponding to different velocity levels in response to repeated musical stimuli. For instance, input provided by a user can be received at playback subsystem 104 from UI subsystem 102. In some embodiments, the input may correspond to an instruction to playback an arrangement of audio samples.

Upon receipt of the input, playback subsystem 104 can begin playing back the arrangement of audio samples in accordance with arrangement data 108 stored in memory subsystem 106. During the playback, repeated stimuli corresponding to the same instrument can be received (e.g., within the arrangement and/or from an external controller). For instance, the particular arrangement stored in arrangement data 108 may include repeated guitar notes having the same velocity level. When an initial stimulus (e.g., the first instance of the guitar note) is received, in some embodiments, sample selection subsystem 114 can retrieve an audio sample associated with the particular velocity level from audio samples 112 for playback. When a subsequent stimulus (e.g., the second instance of the guitar note) having the particular velocity level is received, in some embodiments, sample selection subsystem 114 can retrieve an audio sample associated with a different velocity level. For instance, sample selection subsystem 114 can select an audio sample associated with a higher or lower velocity level than that of the received stimuli.

In some embodiments, sample selection parameters 110 can include rules used by sample selection subsystem 114 to select the appropriate audio sample for playback. For instance, in some embodiments, sample selection parameters 110 may include threshold time intervals that determine whether an audio sample associated with a different velocity level is to be selected. In such embodiments, the time interval between the first and second instances of the musical stimulus can be compared to the threshold time intervals. If the time interval between the stimuli exceeds (or, in some embodiments, meets) a threshold time interval, in some embodiments, sample selection subsystem 114 can instead select the same audio sample for playback that was selected in response to the initial stimulus. If an audio sample associated with a different velocity is to be selected (e.g., if the threshold time interval is not exceeded), sample selection parameters 110 can further include rules governing whether an audio sample associated with a higher or lower velocity level is to be selected, how much higher or lower the velocity level of the sample will be, in addition to which audio samples to select in response to a $3^{rd}$ instance, $4^{th}$ instance, etc., of the musical stimulus.

If an audio sample associated with a different velocity level than that of the initial stimulus is selected, the volume level of the audio sample may be higher or lower than that of the initial audio sample. In some embodiments, volume level matching subsystem 118 can "scale" the volume of the subsequent audio sample to more closely "match" the volume level of the initial sample. For instance, if an audio sample associated with a higher velocity is selected in response to the subsequent stimulus, volume level matching subsystem 118 can reduce the volume of the audio sample for playback. Similarly, if an audio sample associated with a lower velocity is selected in response to the subsequent stimulus, volume level matching subsystem 118 can increase the volume level of the audio sample for playback to more closely match the volume level of the initial audio sample. In some embodiments, volume level matching can be accomplished by increasing or reducing the overall volume level of the selected audio sample until its peak level (e.g., the point on the audio waveform with the highest amplitude) is approximately equal to that of the initial audio sample. In some embodiments, a reduction or increase in volume level can be uniform across the audio sample. In some other embodiments, changes in volume level can be applied differently across the audio sample (e.g., by applying different scaling parameters to the "attack" and "tail" portions of the waveform).

In some embodiments, after modification of the volume level by volume level matching subsystem 118, playback subsystem 104 can utilize an audio output device (e.g., a speaker) of UI subsystem 102 to playback the selected audio sample associated with the different velocity level.

In the examples described above in regards to system 100 shown in FIG. 1, playing back an arrangement of audio samples as stored in arrangement data 108 is described. In some embodiments, audio samples can be selected in response to musical stimuli in the context of a live performance. For instance, musical stimuli can be received by system 100 from an external controller (e.g., a MIDI keyboard). Embodiment of the invention appreciate selecting an audio sample based on the excitation state of an instrument, in addition to selecting audio samples having different velocity levels, in response to musical stimuli received from an external controller in the context of a live performance.

Figure 14:
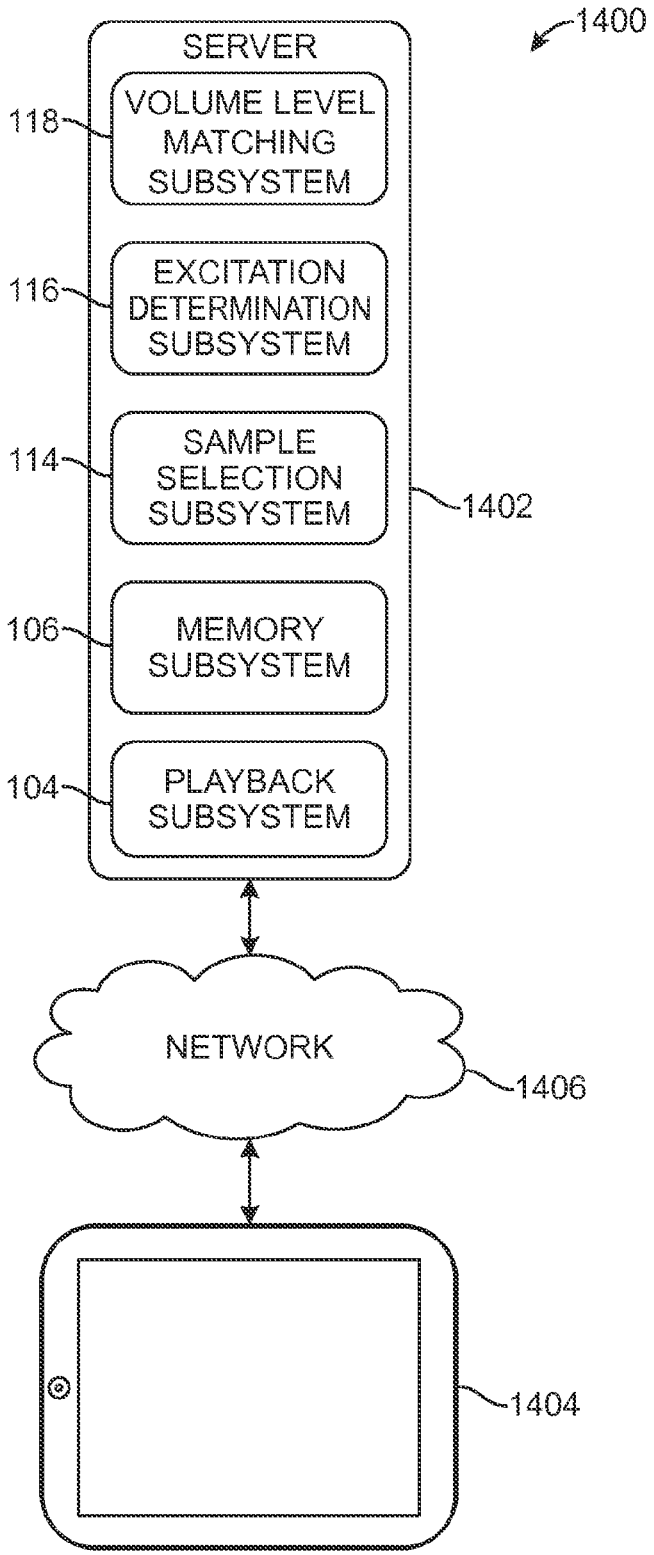
FIG. 14 illustrates a simplified diagram of a distributed system that may incorporate one or more embodiments.

System 100 depicted in FIG. 1 may be provided in various configurations. In some embodiments, system 100 may be configured as a distributed system where one or more components of system 100 are distributed across one or more networks in the cloud. FIG. 14 illustrates a simplified diagram of a distributed system 1400 that may incorporate one or more embodiments. In the embodiments depicted in FIG. 14, playback subsystem 104, memory subsystem 106, sample selection subsystem 114, excitation determination subsystem 116, and volume level matching subsystem 118 are provided on a server 1402 that is communicatively coupled with a computing device 1404 via a network 1406.

Network 1406 may include one or more communication networks, which can be the Internet, a local area network (LAN), a wide area network (WAN), a wireless or wired network, an Intranet, a private network, a public network, a switched network, or any other suitable communication network. Network 1406 may include many interconnected systems and communication links including but not restricted to hardwire links, optical links, satellite or other wireless communications links, wave propagation links, or any other ways for communication of information. Various communication protocols may be used to facilitate communication of information via network 1406, including but not restricted to TCP/IP, HTTP protocols, extensible markup language (XML), wireless application protocol (WAP), protocols under development by industry standard organizations, vendor-specific protocols, customized protocols, and others.

In the configuration depicted in FIG. 14, input provided by a user can be received at computing device 1404 and, in response, computing device 1404 can transmit the input (or data representing the input) to server computer 1402 via network 1406. In some embodiments, the input can correspond to an instruction to playback an arrangement of audio samples. Upon receipt by server computer 1402, playback subsystem 104 can begin playing back the arrangement of audio samples in accordance with the arrangement data 108 stored in memory subsystem 106. During playback, a musical stimulus can be received (e.g., within the arrangement and/or from an external controller) that corresponds to a simulated instrument capable of excitation. As described above with respect to system 100 shown in FIG. 1, in some embodiments, playback subsystem 104, memory subsystem 106, sample selection subsystem 114, and excitation determination subsystem 116, working in cooperation, can select an audio sample based upon the excitation state of the instrument. The selected audio sample can be transmitted (or streamed) by server computer 1402 to computing device 1404 via network 1406. In some embodiments, computing device 1404 can utilize an audio output device (e.g., a speaker) to playback the audio sample.

In some embodiments, during playback, repeated stimuli corresponding to the same instrument can be received (e.g., in an arrangement and/or from an external controller). As described above with respect to system 100 shown in FIG. 1, in some embodiments, playback subsystem 104, memory subsystem 106, sample selection subsystem 114, and volume level matching subsystem 118, working in cooperation, can select audio samples corresponding to different velocity levels in response to the repeated musical stimuli. The selected audio samples can be transmitted (or streamed) by server computer 1402 to computing device 1404 via network 1406. In some embodiments, computing device 1404 can utilize an audio output device (e.g., a speaker) to playback the audio samples corresponding to different velocity levels.

In the configuration depicted in FIG. 14, playback subsystem 104, memory subsystem 106, sample selection subsystem 114, excitation determination subsystem 116, and volume level matching subsystem 118 are remotely located from computing device 1404. In some embodiments, server 1402 may facilitate the selection of audio samples in response to musical stimuli, as described herein, for multiple computing devices. The multiple computing devices may be served concurrently or in some serialized manner. In some embodiments, the services provided by server 1402 may be offered as web-based or cloud services or under a Software as a Service (SaaS) model.

It should be appreciated that various different distributed system configurations are possible, which may be different from distributed system 1400 depicted in FIG. 14. The embodiment shown in FIG. 14 is thus only one example of a distributed system for selecting audio samples in response to musical stimuli and is not intended to be limiting.

As described herein, certain embodiments of the invention are directed to selecting an audio sample based on the excitation state of an instrument and, in some embodiments, the audio samples may correspond to a simulated instrument that is capable of excitation. In some embodiments, such instruments may produce a sound pattern (e.g., a waveform) that decays over time. For instance, such a sound pattern can include an initial "attack" portion having high amplitude sound levels followed by a "tail" portion having sound levels that decay over time. In some embodiments, the excitation caused by playing multiple notes of an instrument may correspond to a superposition of the decaying waveforms associated with the individual notes.

Figure 2:
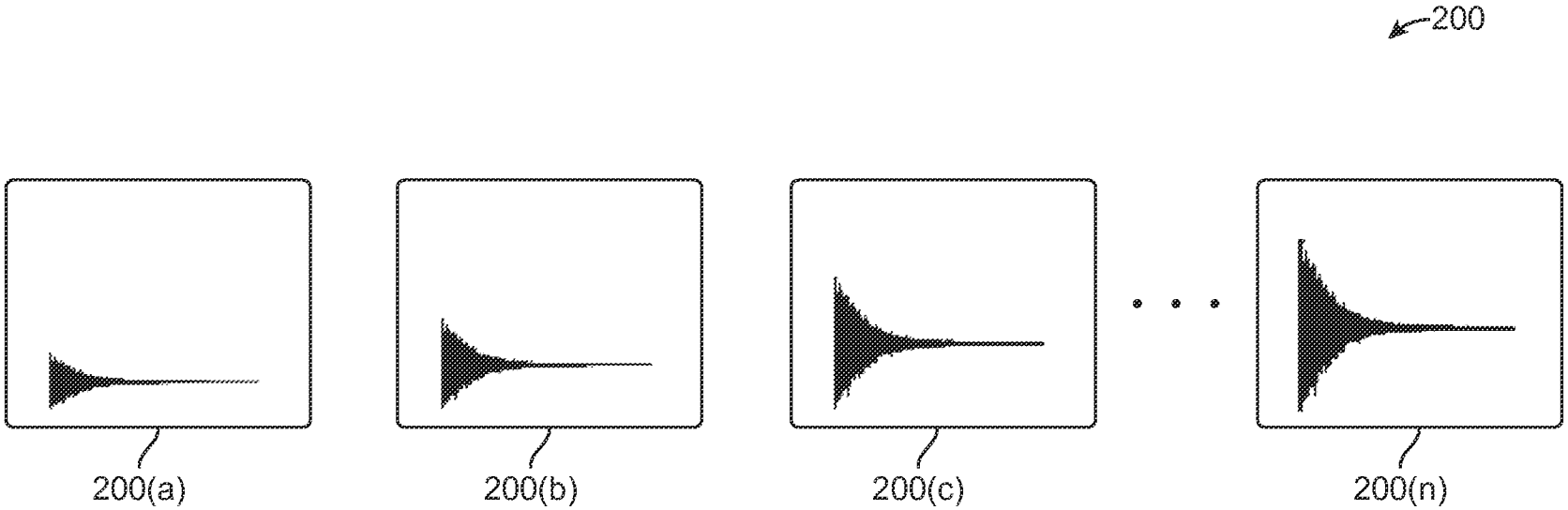
FIG. 2 illustrates a simplified diagram of audio samples corresponding to varying excitation levels of an instrument according to some embodiments.

FIG. 2 illustrates a simplified diagram of audio samples 200 corresponding to varying excitation levels of an instrument according to some embodiments. As depicted in FIG. 2, audio samples 200 corresponding to an instrument can be recorded at various excitation levels of the instrument. In some embodiments, audio samples 200 can be in any suitable audio format such as uncompressed formats, lossless compression formats, lossy compression formats, or any other suitable audio format. Moreover, audio samples 200 may correspond to any suitable musical instrument capable of excitation. In various embodiments, exemplary instruments can include a drum kit having various pieces or components (e.g., a ride cymbal, crash cymbal, hi-hat, bass drum, one or more toms, snare, etc.), other percussion instruments (e.g., a gong, bell, etc.), a stringed instruments (e.g., a guitar, bass, piano, etc.), or any other suitable instrument capable of excitation.

As further depicted in FIG. 2, one or more of audio samples 200 can correspond to a different excitation level of the recorded instrument. In the example shown in FIG. 2, audio samples 200 include a plurality of audio samples 200(*a*), 200(*b*), 200(*c*) . . . 200(*n*) that correspond to increasing excitation levels. In various embodiments, audio samples corresponding to any suitable number of excitation levels of an instrument can be recorded. In some embodiments, audio samples 200 can be recorded by varying the excitation level of the recorded instrument. For instance, audio sample 200(*a*) can be a recording of a note being played when the instrument is at rest, audio sample 200(*b*) can be a recording of a second note being played when the instrument has excitation caused by the first note, audio sample 200(*c*) can be a recording of a third note being played when the instrument has excitation caused by the first and second notes, and so forth. Such audio samples can be recorded using any suitable intervals of excitation, and can be recorded by a user, an audio sample provider, or any other suitable entity.

In some embodiments, audio samples 200 may correspond to a particular velocity level of the instrument. In some embodiments, a distinct set of audio samples corresponding to different excitation levels can be recorded for one or more velocity levels of an instrument. In some embodiments, one or more of audio samples 200 may each be associated with a threshold level. As described in further detail below, such threshold levels can be used to determine which of audio samples 200 best simulates the current excitation state of the corresponding instrument. In some embodiments, threshold levels can be stored separately from audio samples 200, such as in sample selection parameters 110 in system 100 shown in FIG. 1. In some embodiments, threshold levels can be stored as metadata corresponding to audio samples 200.

FIGS. 3-8 illustrate simplified diagrams of selecting an audio sample based on the excitation state of an instrument according to some embodiments. The examples shown in FIGS. 3-8 are not intended to be limiting. As described herein, embodiments may incorporate a computing device. For instance, audio samples can be selected and played back by a computing device including system 100 shown in FIG. 1. Audio sample selections can also be performed by any other suitable computing device incorporating any other suitable components according to various embodiments of the invention.

In FIGS. 3-8, a user interface is shown that may correspond to a DAW running on the computing device. This, however, is not intended to be limiting. Audio samples can be selected and/or played back in the context of any suitable application according to various embodiments. As further depicted in FIGS. 3-8, the user interface can display arrangements that incorporate a drum kit including a hi-hat, snare, bass drum, tom, ride cymbal, and crash cymbal. This is also intended to be non-limiting. As described herein, audio samples corresponding to any suitable instrument or component(s) can be selected based on the excitation state of the instrument. In some embodiments, the various musical arrangements displayed in the user interface of FIGS. 3-8 can be previously stored arrangements and/or can be provided in the context of a live performance. In some embodiments, the displayed arrangements can be provided to the computing device via an external controller such as a MIDI keyboard.

Figure 3:
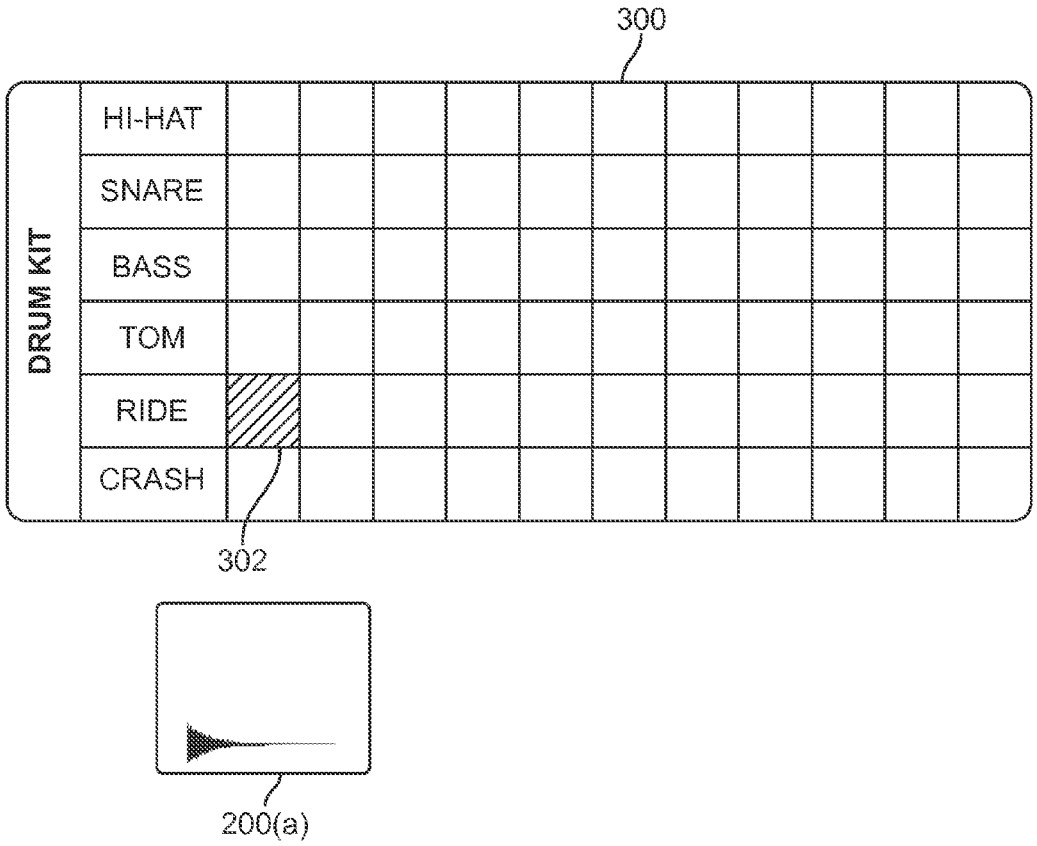
FIGS. 3-8 illustrate simplified diagrams of selecting an audio sample based on the excitation state of an instrument according to some embodiments.

In FIG. 3, an arrangement 300 is illustrated that includes a musical stimulus 302 corresponding to a note played on a drum kit and, in particular, a ride cymbal. As depicted in FIG. 3, musical stimulus 302 can correspond to the first ride cymbal note included in the arrangement. Thus, in this example, musical stimulus 302 is received when the simulated ride cymbal is at rest. During playback of the arrangement, in response to musical stimulus 302, the computing device can calculate a current excitation level associated with previously received musical stimuli. In this example, such a calculation may involve determining whether previously received stimuli corresponding to ride cymbal notes are currently being played back. In FIG. 3, since music stimulus 302 is detected when the simulated ride cymbal is at rest, the computing device can determine that the current excitation state of the ride cymbal is zero.

Upon determining the current excitation level, the computing device can select an appropriate audio sample that reflects the excitation state of the instrument. For instance, as depicted in FIG. 3, the computing device may determine that audio sample 200(*a*) corresponds to a ride cymbal note being played when the current excitation state is zero (e.g., when the cymbal is at rest). The computing device may then playback audio sample 200(*a*) using an audio output device such as a speaker.

Figure 4:
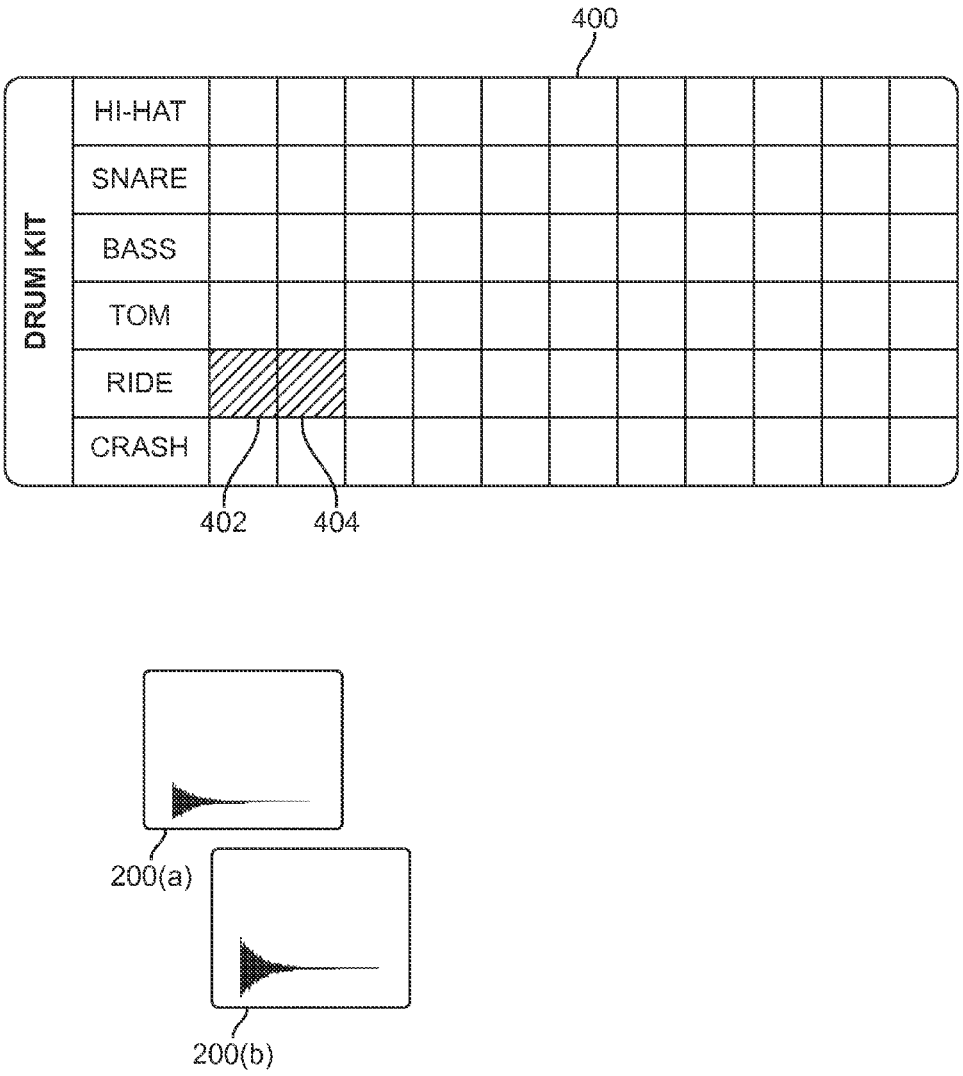

In FIG. 4, an arrangement 400 is illustrated that includes two musical stimuli, 402 and 404, that correspond to notes played on the ride cymbal. As described above in the context of musical stimulus 302 shown in FIG. 3, in response to musical stimulus 402, the computing device can select and playback audio sample 200(*a*) corresponding to a note being played when the ride cymbal is at rest. As depicted in FIG. 4, audio sample 200(*a*) corresponding to musical stimulus 402 may be currently playing back at the point in time at which musical stimulus 404 is reached or detected. Thus, in response to musical stimulus 404, the computing device can calculate the current excitation level of the ride cymbal caused by musical stimulus 402. In some embodiments, the computing device can calculate the current excitation level of an instrument by summing the individual excitation levels of previously received stimuli that are currently being played back. In some embodiments, excitation levels can be approximated by volume levels. Thus, in the example shown in FIG. 4, the computing device can determine that audio sample 200(*a*) is currently being played back, and can identify its current volume level.

In some embodiments, to select the appropriate audio sample for playback, the calculated excitation level (e.g., the summed volume level) of previously received stimuli can be compared to threshold levels. In the example shown in FIG. 4, the computing device can compare the current volume level of audio sample 402(*a*) to threshold levels assigned to audio samples correspond to the simulated instrument (e.g., the ride cymbal). For instance, in some embodiments, the computing device can determine which threshold levels are met or exceeded by the current volume level. Based on this comparison, the computing device may select an audio sample for playback with the highest threshold level that is met or exceeded. In the example shown in FIG. 4, the computing device may determine that the threshold level assigned to audio sample 200(*b*) is the highest threshold met or exceeded by the current volume level of audio sample 200(*a*). In some embodiments, by selecting audio sample 200(*b*), the computing device can simulate the excitation of the ride cymbal caused by musical stimulus 404 being received when the ride cymbal currently has excitation caused by musical stimulus 404. Upon selection, the computing device may then playback audio sample 200(*b*).

Figure 5:
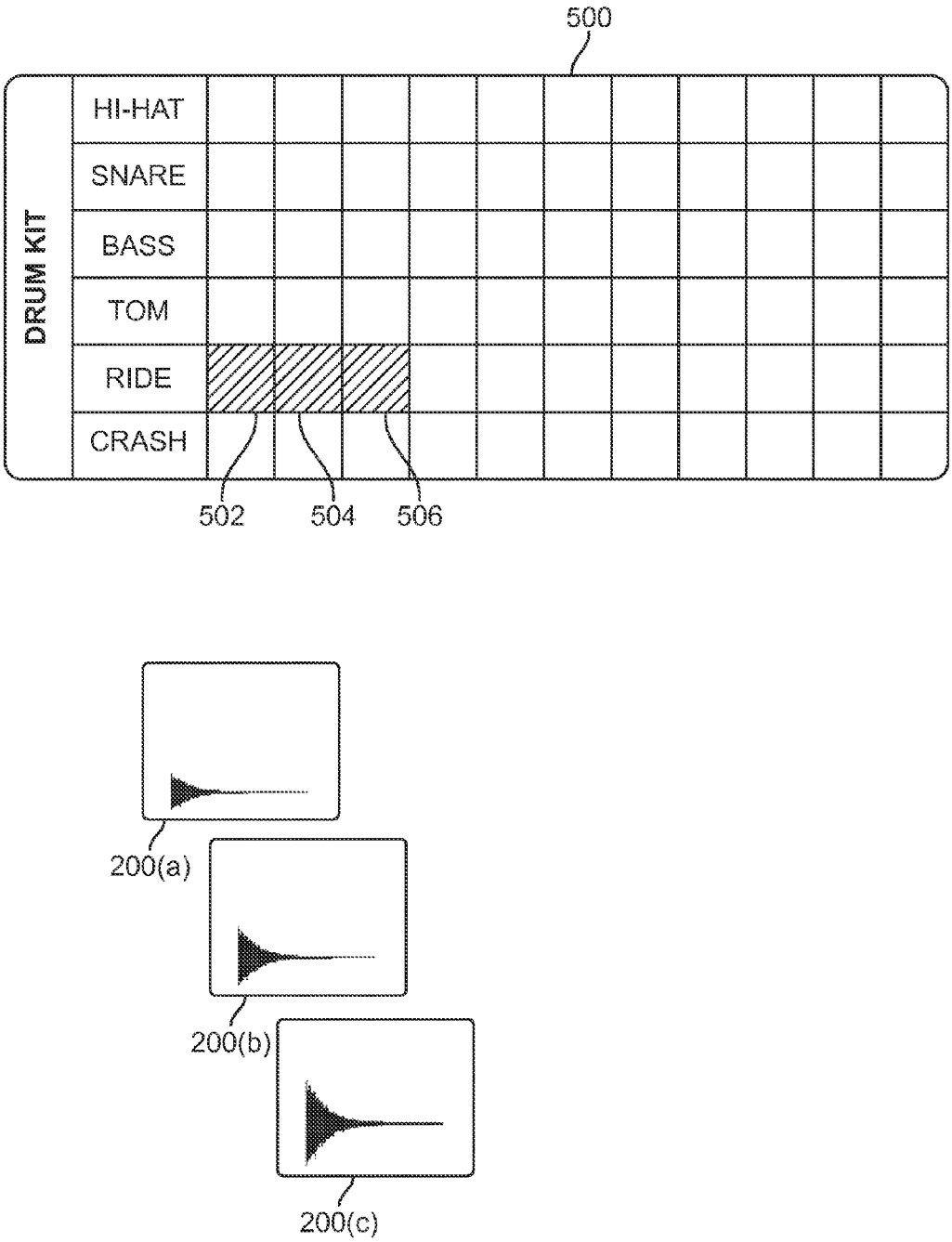

In FIG. 5, an arrangement 500 is illustrated that includes three musical stimuli, 502, 504, and 506. As described above in the context of musical stimuli 402 and 404 shown in FIG. 4, in response to musical stimuli 502 and 504, the computing device can select and playback audio samples 200(*a*) and 200(*b*), respectively. As depicted in FIG. 5, audio samples 200(*a*) and 200(*b*) may both be currently playing back at the point in time at which musical stimulus 506 is reached or detected. In response to musical stimulus 506, the computing device can calculate the current excitation level of the ride cymbal by summing the individual excitation levels of the previously received ride cymbal notes (e.g., musical stimuli 502 and 504) that are currently being played back. In some embodiments, excitation levels can be approximated by volume levels. In the example shown in FIG. 5, upon determining that audio samples 202(*a*) and 202(*b*) are currently being played back, the computing device can identify and sum their individual volume levels.

The summed volume levels can be compared to threshold levels assigned to audio samples corresponding to the simulated instrument (e.g., the ride cymbal). In some embodiments, the computing device can select an audio sample for playback with the highest threshold level that is met or exceeded by the calculated excitation level (e.g., the summed volume levels of audio samples 200(*a*), 200(*b*)). In the example shown in FIG. 5, the computing device may determine that the threshold level assigned to audio sample 200(*c*) is highest threshold met or exceeded by the current excitation level. In some embodiments, by selecting audio sample 200

(*c*), the computing device can simulate the excitation of the ride cymbal caused by musical stimulus 506 being received when the ride cymbal currently has excitation caused by musical stimuli 502 and 504. Upon selection, the computing device may playback audio sample 200(*c*).

As illustrated in FIG. 2, audio samples 200 can include any suitable number of samples. In some embodiments, a saturation of instrument excitation can be simulated. For instance, in some embodiments, audio sample 200(*n*) may correspond to the highest level of instrument excitation as compared to the rest of audio samples 200. In such embodiments, in response to a musical stimulus that occurs when audio sample 200(*n*) is currently being played back (i.e. when the excitation level of the instrument is at a maximum), the computing device can again select audio sample 200(*n*) for playback despite an increase in excitation caused by the stimulus. Thus, until the excitation level falls below the threshold level assigned to audio sample 200(*n*), the saturation of excitation may continue to result in audio sample 200(*n*) being selected for playback in response to subsequently received stimuli.

Figure 6:
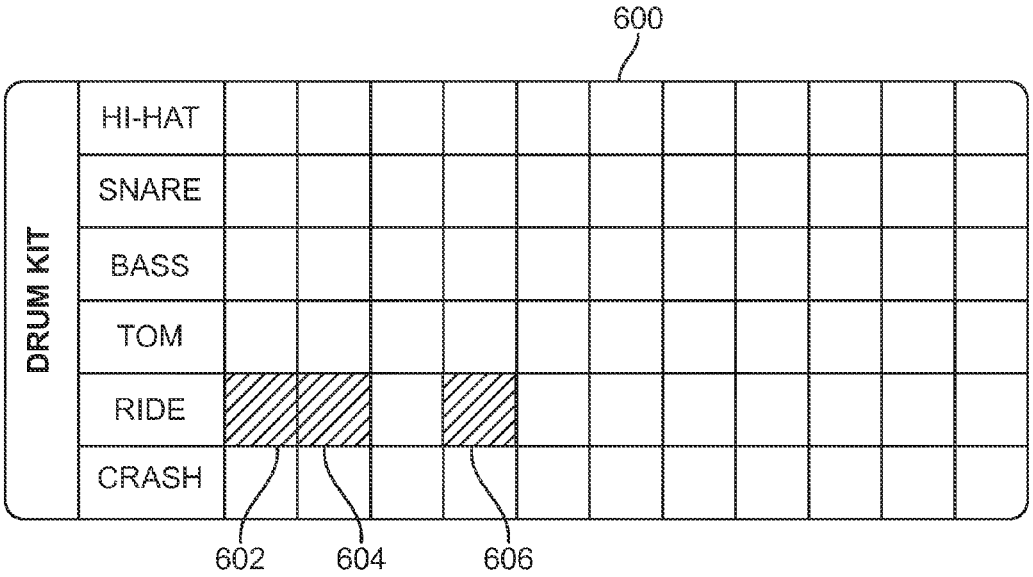
Figure 6:
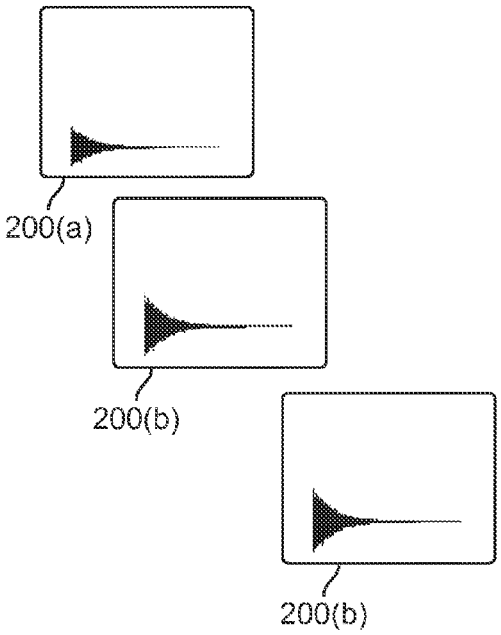

In FIG. 6, an arrangement 600 is illustrated that includes three musical stimuli, 602, 604, 606. As described above in the context of musical stimuli 402 and 404 shown in FIG. 4, and musical stimuli 502 and 504 shown in FIG. 5, in response to musical stimuli 602 and 604, the computing device can select and playback audio samples 200(*a*) and 200(*b*), respectively. As further depicted in FIG. 6, musical stimuli 604 and 606 are positioned two beats apart in arrangement 600. Although audio sample 200(*b*) may be currently playing back at the point in time at which musical stimulus 606 is detected, in this example, the playback of audio sample 200(*a*) may have ended. Thus, the current excitation level of the ride cymbal may be less when musical stimulus 606 is detected in arrangement 600 than when musical stimulus 506 is detected in arrangement 500 as described above in the context of FIG. 5.

In response to musical stimulus 606, the computing device can calculate the current excitation level of the previously received ride cymbal notes that are currently being played. In FIG. 6, since audio sample 200(*b*) is the only sample being played when musical stimulus 606 is detected, the excitation level of the ride cymbal can be approximated by the current volume level of audio sample 200(*b*).

The volume level of audio sample 200(*b*) can be compared to threshold levels assigned to audio samples corresponding to the simulated instrument (e.g., the ride cymbal). In this example, the computing device may determine that the threshold level assigned to audio sample 200(*b*) is the highest threshold met or exceeded by the current excitation level. Thus, the current excitation level may be insufficient to trigger audio sample 200(*c*) in this example since the spacing between musical stimuli 404 and 406 has allowed playback of audio sample 200(*a*) to end. By again selecting audio sample 200(*b*), the computing device can simulate the excitation of the ride cymbal caused by musical stimulus 606 being received when the ride cymbal excitation caused by musical stimulus 604 but not musical stimulus 602. Upon selection, the computing device may playback audio sample 200(*b*).

Figure 7:
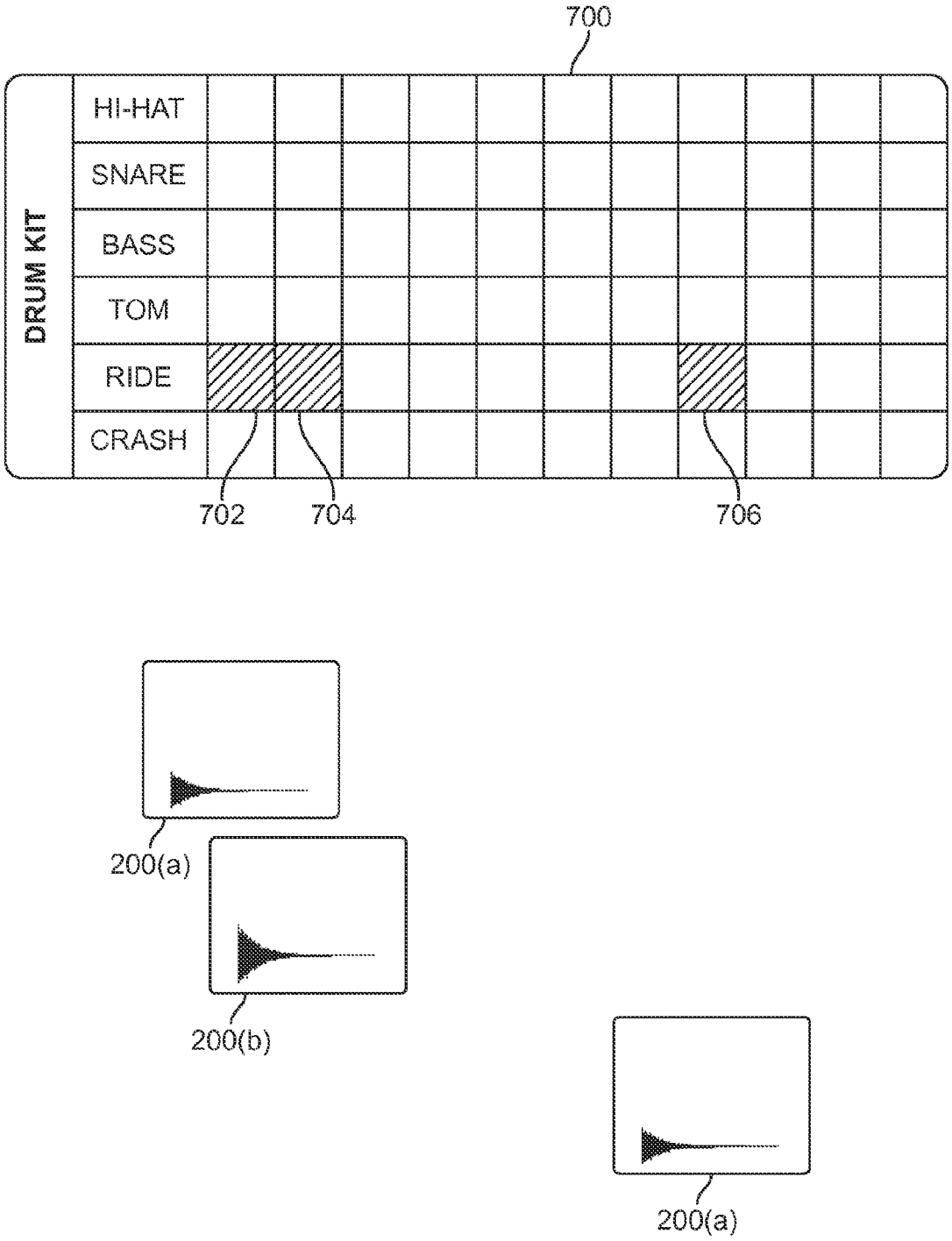

In FIG. 7, an arrangement 700 is illustrated that includes three musical stimuli, 702, 704, and 706. As described above in the context of musical stimuli 402 and 404 shown in FIG. 4, musical stimuli 502 and 504 shown in FIG. 5, and musical stimuli 602 and 604 shown in FIG. 6, in response to musical stimuli 702 and 704, the computing device can select and playback audio samples 200(*a*) and 200(*b*), respectively. As further depicted in FIG. 7, musical stimuli 704 and 706 are positioned six beats apart in arrangement 700. In this example, the playback of audio samples 200(*a*) and 200(*b*) has ended at the point in time at which musical stimulus 706 is reached or detected. Thus, the current excitation level of the ride cymbal can be zero in this example.

In response to musical stimulus 706, the computing device can determine that the current excitation level (e.g., the current volume level) of previously received stimuli is zero. Based on the calculation, the computing device can select the audio sample with an excitation level corresponding to the ride cymbal being at rest. For instance, as depicted in FIG. 7, the computing device may again determine that audio sample 200(*a*) corresponds to a ride cymbal note being played when the cymbal is at rest. The computing device can then play back selected audio sample 200(*a*).

Figure 8:
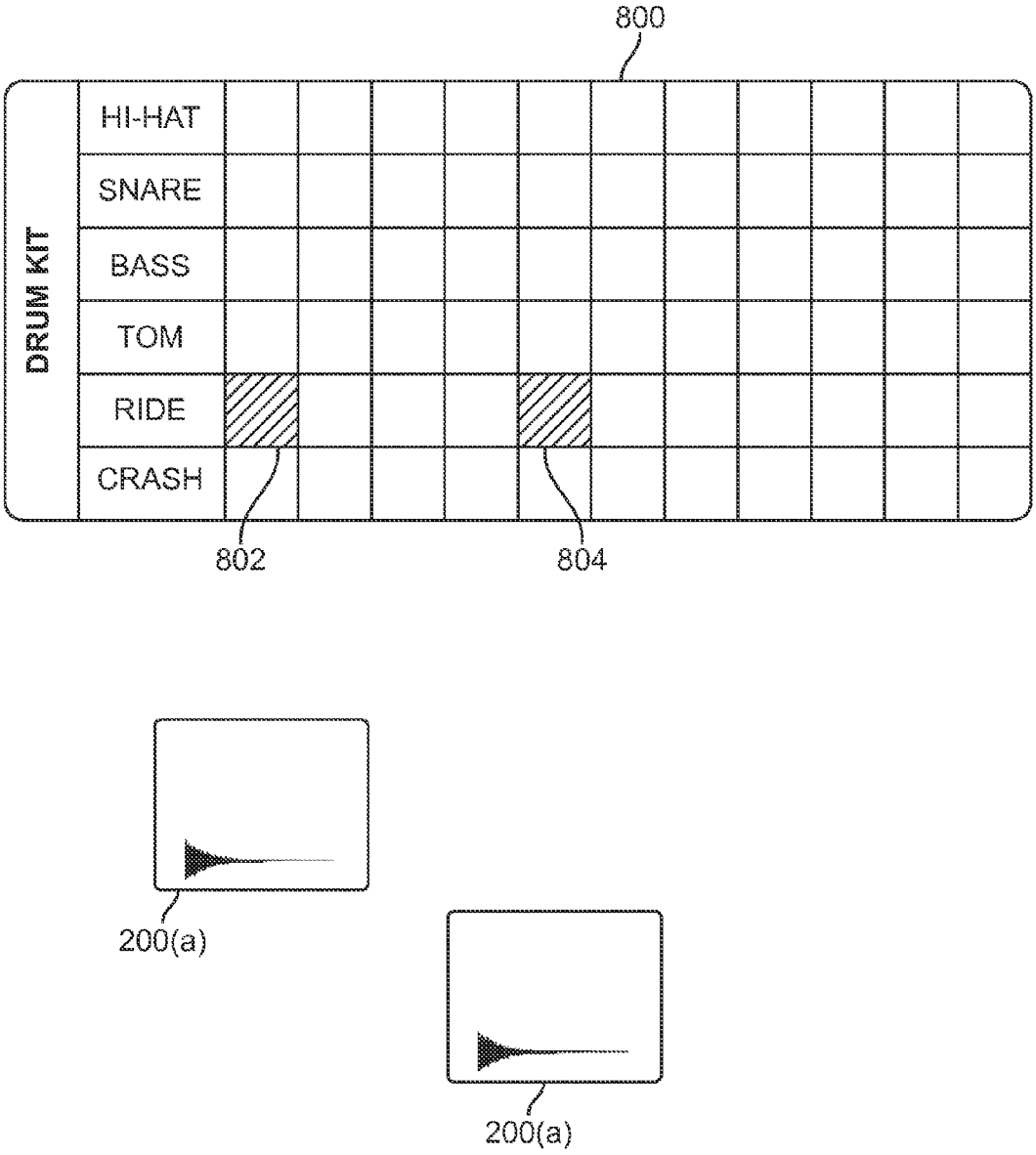

In FIG. 8, an arrangement 800 is illustrated that includes two musical stimuli, 802 and 804. As depicted in FIG. 8, musical stimuli 802 and 804 are positioned four beats apart in arrangement 800. As described above, in response to musical stimulus 802, the computing device can select and playback audio sample 200(*a*) corresponding to a note being played when the ride cymbal is at rest. In FIG. 6, the playback of audio sample 200(*a*) has ended at the point in time at which musical stimulus 804 is reached or detected. Thus, the current excitation of the ride cymbal can be zero in this example.

In response to musical stimulus 804, the computing device can determine that the current excitation level of the previously received stimuli (e.g., musical stimuli 802) is zero. Based on the calculation, the computing device can select the audio sample with an excitation level corresponding to a ride cymbal being played when the cymbal is at rest. Thus, as depicted in FIG. 8, the computing device can again select and playback audio sample 200(*a*).

In some embodiments, as described above, a set of audio samples may correspond to a particular velocity level, and sets of audio samples can be recorded for a plurality of velocity levels of an instrument. Moreover, in some embodiments, threshold levels assigned to a set of audio samples corresponding to a particular velocity level may be different than the threshold levels assigned to a set of audio samples corresponding to a different velocity level. Thus, in response to a musical stimulus, the computing device may determine the velocity level of the stimulus to identify the appropriate set of threshold values to analyze. If a stimulus corresponding to a low velocity level is followed by a stimulus corresponding to a high velocity level, the excitation caused by the initial stimulus may be small or even insignificant in comparison to the excitation caused by the subsequent stimulus. Thus, when the current excitation caused by the low velocity stimulus are compared to threshold values corresponding to the high velocity stimulus, a high velocity audio sample corresponding to the instrument being at rest may be selected. Similarly, if a stimulus corresponding to a high velocity level is followed by a stimulus corresponding to a low velocity level, the excitation caused by the subsequent stimulus may be small or insignificant in comparison to the excitation caused by the initial stimulus. When the current excitation caused by the high velocity stimulus is compared to threshold values corresponding to the low velocity stimulus, a low velocity audio sample corresponding to the instrument being at a high level of excitation may be selected. However, the selected audio sample may be associated with the same or a lower excitation level than that played back in response to the initial high velocity stimulus.

In some embodiments, a simulated instrument can include different regions or components that are associated with independent excitation levels. For instance, an actual cymbal can include a "bell" portion and an "outer" portion that produce different sound patterns when played, and that generate excitation energy independently. The bell portion of a cymbal can have a high level of excitation energy when the outer portion has a low or negligible level of excitation energy, and vice versa. In some embodiments, in response to stimuli corresponding to playing notes on such instruments, the excitation of different regions or components can be calculated independently and appropriate audio samples selected accordingly.

In some embodiments, audio samples can be played back in a simultaneous format. For instance, a musical stimulus can be received during playback of an audio sample corresponding to a particular excitation. In some embodiments, when an audio sample is selected and played back for the instant stimulus, the playback of the previous audio sample may continue. Thus, the audio samples corresponding to the first and second stimuli can be played back simultaneously using different tracks or channels. Similarly, if a third stimulus is received, a selected audio sample can be played back simultaneous with the decaying first and second audio samples. In some embodiments, a threshold number of simultaneous audio samples can be played back. For instance, in some embodiments, if a fourth stimulus is received, a selected audio sample may be played back simultaneous with the decaying second and third audio samples, but playback of the first audio sample can be terminated.

Figure 9:
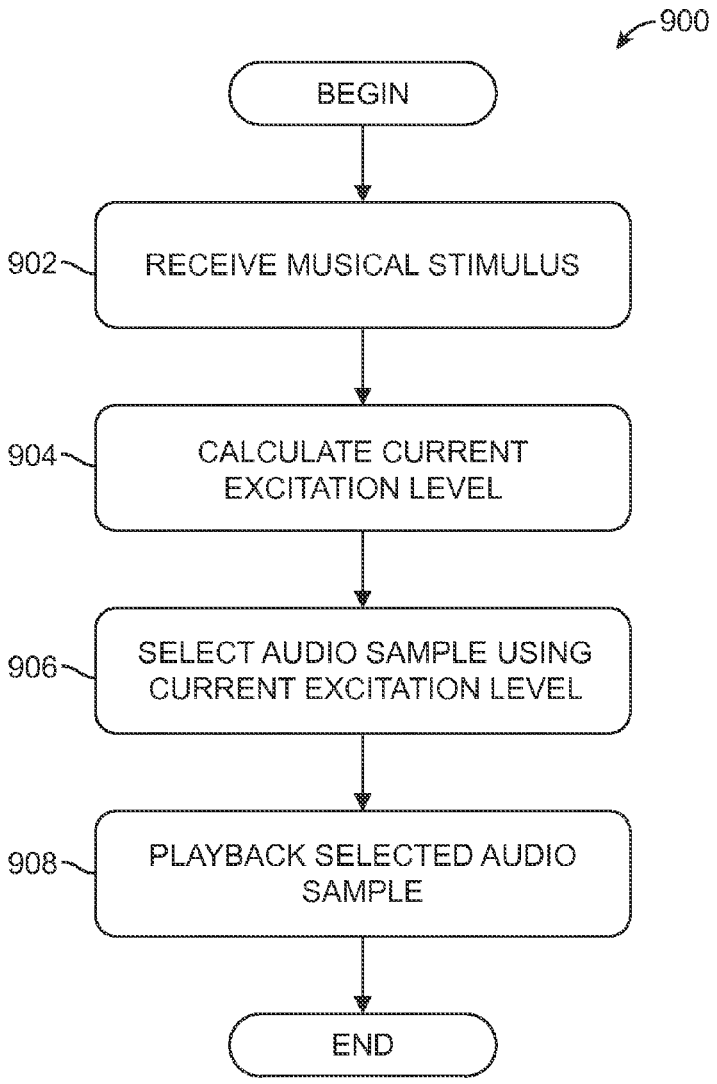
FIG. 9 illustrates a simplified flowchart depicting a method of selecting an audio sample based on the excitation state of an instrument according to some embodiments.

FIG. 9 illustrates a simplified flowchart depicting a method 900 of selecting an audio sample based on the excitation state of an instrument according to some embodiments. The processing depicted in FIG. 9 may be implemented in software (e.g., code, instructions, and/or a program) executed by one or more processors, hardware, or combinations thereof. The software may be stored on a non-transitory computer-readable storage medium (e.g., as a computer-program product). The particular series of processing steps depicted in FIG. 9 are not intended to be limiting.

As illustrated in FIG. 9, at step 902, a musical stimulus can be received by a computing device. In some embodiments, the musical stimulus can correspond to a musical instrument that produces a decaying audio pattern (e.g., a cymbal, open hi-hat, gong, bell, guitar, bass, piano, etc.). In some embodiments, the musical stimulus may be received in the context of a stored arrangement including a plurality of stimuli, and may also be received from an external controller (e.g., a MIDI keyboard). In some embodiments, the musical stimulus can be received in the context of a live musical performance.

At step 904, a current excitation level associated with previously received musical stimuli can be calculated. For instance, the individual excitation levels associated with previously received musical stimuli corresponding to the same instrument can be determined and summed to generate the current excitation level. In some embodiments, the individual excitation levels can be determined based upon the individual volume levels of the previously received stimuli as currently being played back.

At step 906, an audio sample corresponding to the received music stimulus can be selected, the audio sample being selected using the calculated current excitation level associated with the previously received musical stimuli. For instance, in some embodiments, the current excitation level associated with the previously received stimuli can be compared with threshold levels assigned to a plurality of audio samples corresponding to the received musical stimulus, the plurality of audio samples corresponding to different excitation levels. In such embodiments, at step 906, selecting the audio sample can include determining that the current excitation level exceeds a threshold level assigned to the selected audio sample. In some embodiments, a velocity level of the received musical stimulus can be determined. In such embodiments, the plurality of audio samples, including the selected sample, may correspond to the determined velocity level. At step 908, the selected audio sample can be played back.

In some embodiments, upon initiating playback, the first musical stimulus can be identified as a previously received musical stimulus, and a second musical stimulus can be received. The current excitation level associated with the previously received musical stimuli including the first musical stimulus can be calculated. An audio sample corresponding to the received second musical stimulus can be selected, the second audio sample being selected using the current excitation level associated with the previously received musical stimulus including the first musical stimulus. The selected second audio sample can be played back. In some embodiments, the second audio sample can correspond to a different excitation level than the first audio sample. In some embodiments, the playback of the first audio sample can continue when the second audio sample is played back. In some embodiments, playback of the first audio sample can end when the playback of the second audio sample is initiated.

By storing audio samples of varying excitation levels, calculating the current excitation behavior of a simulated instrument, and selecting an audio sample accordingly, the excitation state of a real instrument can be reproduced. Thus, a more natural sounding and realistic simulation of a live performance using a real musical instrument can be provided.

As described herein, certain embodiments are further described that provide for selecting audio sample having different velocity levels in response to repeated musical stimuli. In some embodiments, audio samples corresponding to an instrument playing a particular note may be recorded at various "velocity" levels (e.g., the speed or force with which a note has been struck). For instance, in some embodiments, a MIDI format supports 127 different velocity levels (e.g., 1 to 127). In various embodiments, the recorded audio samples may correspond to any suitable instrument. For instance, audio samples having different velocity levels that are selected in response to repeated musical stimuli may correspond to instruments capable of excitation (as described herein), instruments capable of a small amount of excitation or incapable of excitation (e.g., a wood block, closed hi-hat, etc.), or any other suitable musical instrument. In various embodiments, the audio samples can be in any suitable audio format such as uncompressed formats, lossless compression formats, lossy compression formats, or any other suitable audio format.

Figure 10:
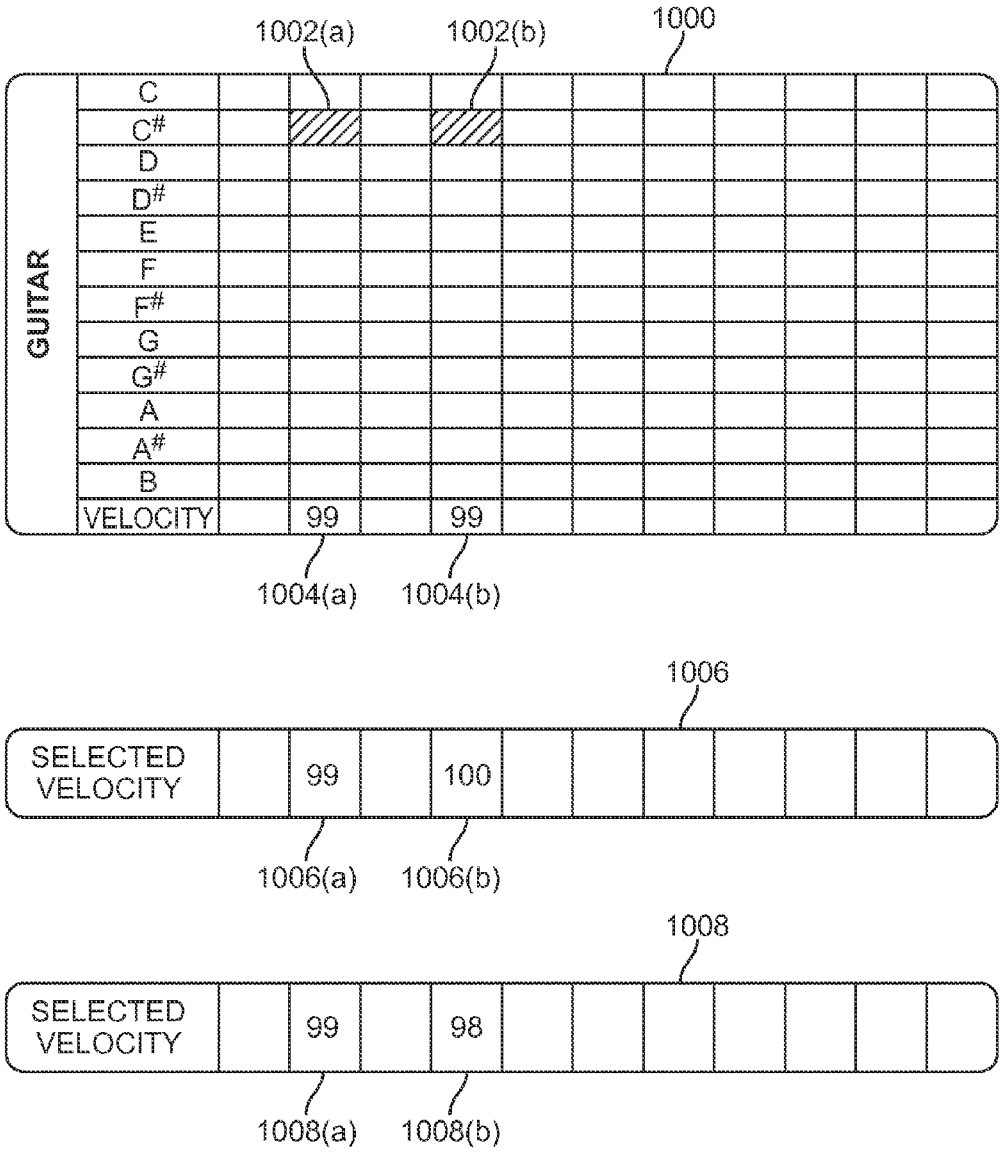
FIGS. 10-12 illustrate simplified diagrams of selecting audio samples having different velocity levels in response to repeated musical stimuli according to some embodiments.
Figure 11:
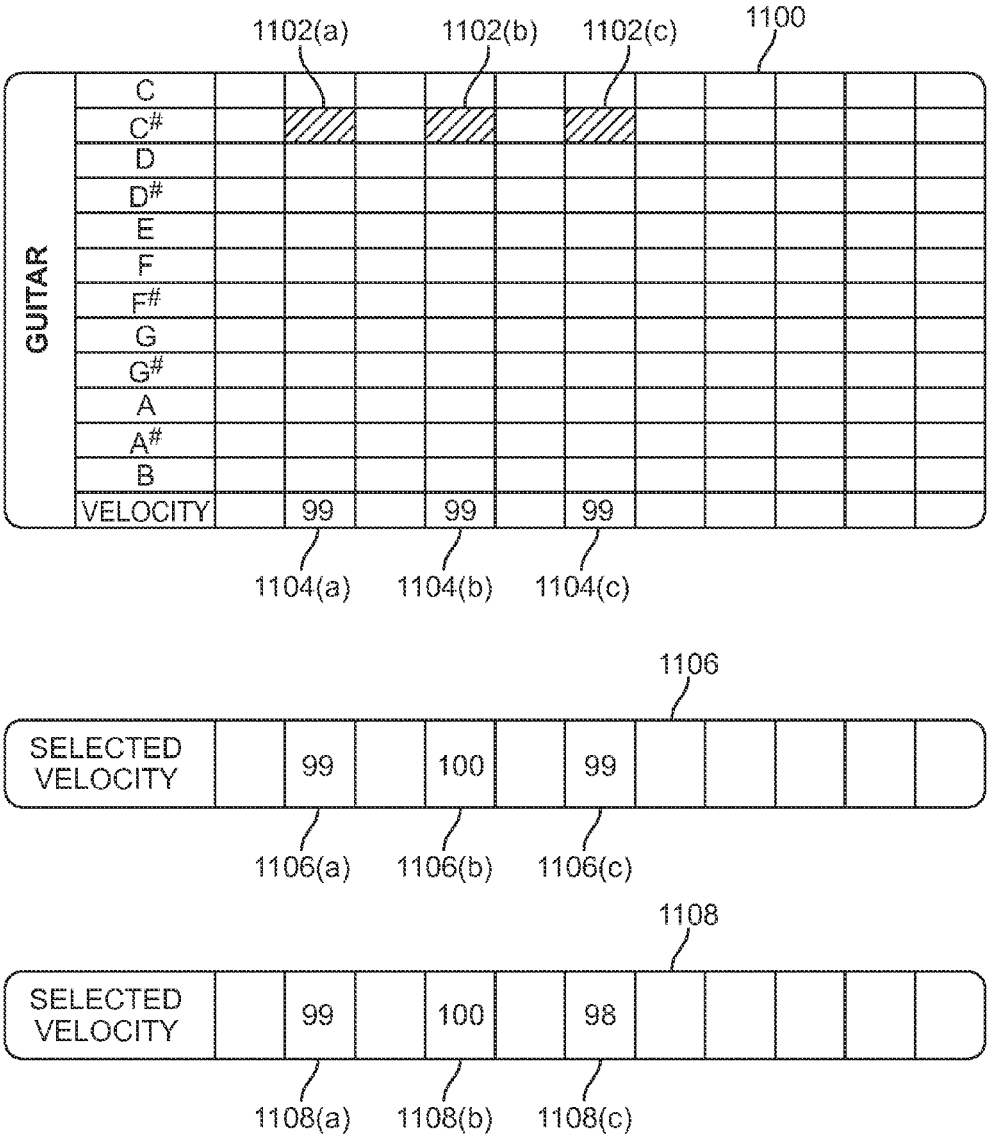
Figure 12:
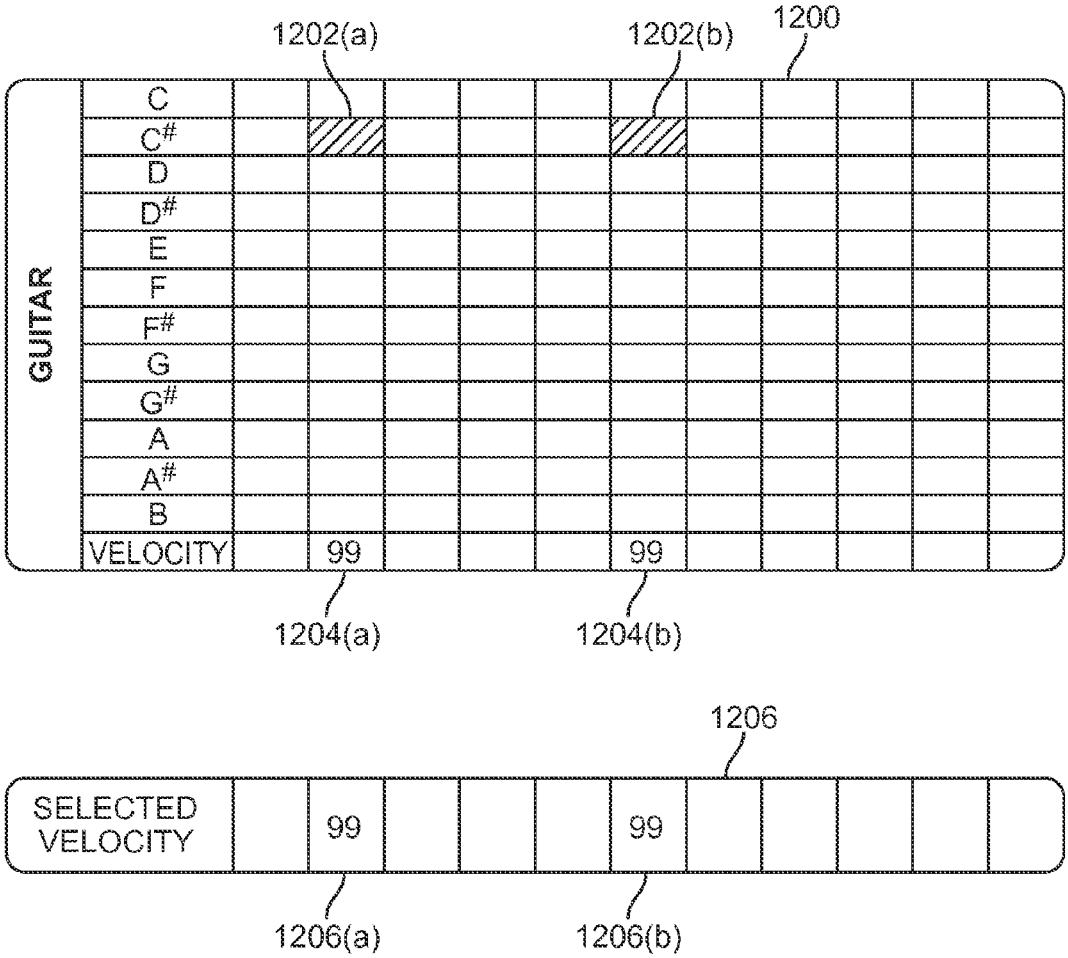

FIGS. 10-12 illustrate simplified diagrams of selecting audio samples having different velocity levels in response to repeated musical stimuli according to some embodiments. The examples shown in FIGS. 10-12 are not intended to be limiting. As described herein, embodiments may incorporate a computing device. For instance, audio sample having different velocity levels can be selected in response to repeated musical stimuli by a computing device including system 100 shown in FIG. 1. Audio sample selections can also be performed by any other suitable computing device incorporating any other suitable components according to various embodiments of the invention.

In FIGS. 10-12, a user interface is shown that may correspond to a DAW running on the computing device. This, however, is not intended to be limiting. Audio samples can be selected and/or played back in the context of any suitable application according to various embodiments. As further depicted in FIGS. 10-12, the user interface can display arrangements that incorporate a simulated guitar. This is also not intended to be limiting. As described above, audio samples corresponding to any suitable instrument or instrument component(s) can be selected in response to repeated musical stimuli. In some embodiments, the various musical arrangements displayed in the user interface of FIGS. 10-12 can be previously stored arrangements and/or can be provided in the context of a live performance. In some embodiments, the displayed arrangements can be provided to the computing device via an external controller such as a MIDI keyboard. Additionally the particular examples of velocity levels depicted in FIGS. 10-12 are provided as mere examples, and are not intended to be limiting.

In FIG. 10, an arrangement 1000 is illustrated that includes two musical stimuli, 1002(*a*) and 1002(*b*), corresponding to repeated notes of the same velocity level. In particular, as illustrated in FIG. 10, musical stimulus 1002(*a*) corresponds to a first instance of a C♯ note being played on a guitar with a velocity level 1004(*a*) of 99, and musical stimulus 1002(*b*) corresponds to a second repeated instance of the C♯ note being played on the guitar with a velocity level 1004(*b*) of 99. As further depicted FIG. 10, playback maps 1006 and 1008 illustrate the velocity level of audio samples that may be selected in response to the repeated musical stimuli according to some embodiments. It should be noted that playback maps 1006 and 1008 are provided for purposes of discussion and that, in various embodiments of the invention, a computing device may or may not incorporate such playback maps.

In response to the first instance of the musical stimulus, the computing device can select and playback an audio sample that corresponds to the same note and velocity as the received stimulus. For instance, as illustrated by playback map 1006, in response to musical stimulus 1002(*a*), the computing device can select and playback an audio sample that corresponds to a guitar note (C♯) with a velocity level 1006(*a*) of 99.

In some embodiments, in response to the second instance of the musical stimulus, the computing device can select an audio sample that corresponds to a different velocity level. For instance, as illustrated by playback map 1006, in response to musical stimulus 1002(*b*), the computing device can select an audio sample that corresponds to the same guitar note (C♯) but with a different velocity level 1006(*b*), i.e. a higher velocity level of 100. In some embodiments, in response to the second instance of the musical stimulus 1002(*b*), an audio sample corresponding to the same note but with a lower velocity level 1008(*b*) can be selected. For instance, as illustrated by playback map 1008 shown in FIG. 10, an audio sample corresponding to a velocity level 1008(*b*) of 98 can be selected.

In the example depicted in FIG. 10, in response to the second instance of the musical stimulus 1002(*b*), the velocity level associated with the stimulus and the velocity level of the selected audio sample are illustrated as "adjacent" velocity steps (i.e. one step apart). In various embodiments, an audio sample selected in response to a repeated musical stimulus can be two steps, three steps, four steps, or any suitable number of velocity steps higher or lower than the velocity level of the repeated stimulus.

In some embodiments, upon selecting the audio sample corresponding to a different velocity level, the computing device can playback the audio sample using an audio output device such as a speaker. In some embodiments, prior to playing back the selected sample, a volume level matching can be performed on the audio sample corresponding to the higher or lower velocity level. For instance, audio samples corresponding to different velocity levels may be associated with different output volume levels since an increase in velocity level (e.g., an increase in the speed or force with which a note has been struck) may generally result in an increase in output volume level. In some embodiments, the computing device can "scale" the volume level of the audio sample selected in response to the second instance of the musical stimulus to more closely match the volume level of the audio sample selected in response to the first instance of the musical stimulus. As an example, referring back to playback map 1006 shown in FIG. 10, if an audio sample is selected that corresponds to a higher velocity level (e.g., 100) than that of the received stimulus (e.g., 99), the computing device can reduce the output volume of the audio sample prior to playback. Similarly, referring back to playback map 1008 shown in FIG. 10, if an audio sample is selected that corresponds to a lower velocity level (e.g., 98) than that of the received stimulus (e.g., 99), the computing device can increase the output volume of the audio sample prior to playback.

In various embodiments, output volume levels can be increased or decreased to more closely match the output volume level of the audio sample played back in response to the first instance of the musical stimulus in a number of different ways. For instance, the overall volume level of the selected audio sample can be increased or decreased until its peak volume level (e.g., the point on the audio waveform with the highest amplitude) is equal or approximately equal to the peak volume level of the audio sample played back in response to the first instance of the musical stimulus. In some embodiments, an increase or decrease in volume level can be applied uniformly across the length of an audio sample. In some other embodiments, volume modifications can be applied in a non-uniform manner. For instance, in the case of an audio sample having a decaying sound pattern, in some embodiments, the volume level of the "attack" portion of the sample can be modified differently than the decaying "tail" portion of the sample. In various embodiments, output volume levels of an audio samples can be increased and/or decreased using any suitable modification parameters.

By performing volume level matching as described above, in some embodiments, the output volume level of the audio sample can more closely match that of the initial audio sample corresponding to the original velocity level while retaining the variation in audio characteristics (e.g., tonal, timbral, and/or other differences) associated with different velocities.

In FIG. 11, an arrangement 1100 is illustrated that includes three musical stimuli, 1102(*a*), 1102(*b*), and 1102(*c*). In particular, as illustrated in FIG. 11, musical stimulus 1102(*a*) corresponds to a first instance of a C♯ note being played on a guitar with a velocity level 1104(*a*) of 99, musical stimulus 1102(*b*) corresponds to a second repeated instance of the C♯ note being played on the guitar with a velocity level 1104(*b*) of 99, and musical stimulus 1102(*c*) corresponds to a third repeated instance of a C♯ note being played on a guitar with a velocity level 1104(*c*) of 99. As further depicted in FIG. 11, playback maps 1106 and 1108 illustrate the velocity level of audio samples than can be selected in response to the repeated musical stimuli according to some embodiments. As with playback maps 1006 and 1008 described above in the context of FIG. 10, it should be noted that playback maps 1106 and 1108 are provided for purposes of discussion and that, in various embodiments of the invention, a computing device may or may not incorporate such playback maps.

As described above in the context of musical stimuli 1002(*a*) and 1002(*b*) shown in FIG. 10, in response to musical stimuli 1102(*a*) and 1102(*b*), the computing device can select and playback audio samples corresponding to different velocity levels. For instance, as illustrated in playback maps 1106, 1108, in response to the first instance of the musical stimulus

1102(*a*), the computing device can select and playback an audio sample that corresponds to the same guitar note (e.g., C♯) and the same velocity level 1106(*a*), 1108(*a*) (e.g., 99) of musical stimulus 1102(*a*). In response to the second instance of the musical instance 1102(*b*), the computing device can select and playback an audio sample that corresponds to the same guitar note (e.g., C♯) but with a higher or lower velocity level. As illustrated in playback maps 1106 and 1108, in response to the second musical stimulus 1102(*b*), an audio sample corresponding to a higher velocity level (1106(*b*), 1108(*b*)), namely a velocity level of 100, can be selected for playback in this example.

In FIG. 11, arrangement 1100 further includes a third instance of the musical stimulus 1102(*c*). Thus, in the example shown in FIG. 11, three repeated notes (e.g., C♯) are received at the same velocity level (e.g., 99). In embodiments of the invention, in response to the third instance of the musical stimulus 1102(*c*), the computing device can select an audio sample for playback in a number of different ways. For instance, in some embodiments, the computing device can select the same audio sample that was played back in response to the first instance of the musical stimulus. Thus, as illustrated in playback map 1106, the computing device can select an audio sample corresponding to a velocity level 1106(*c*), i.e. a velocity level of 99, which can be the same audio sample played back in response to the first instance 1102(*a*) of the musical stimulus. Accordingly, an "oscillating" pattern of velocity levels can be created. In such embodiments, audio samples selected in response to subsequent instances of the musical stimulus can be chosen in accordance with the oscillating pattern (e.g., 99, 100, 99, 100, etc.).

In some other embodiments, in response to the third instance of the musical stimulus 1102(*c*), the computing device can select an audio sample corresponding to a velocity level that creates an "alternating" pattern of velocity levels. For instance, as illustrated in playback map 1108, the computing device can select an audio sample that corresponds to a velocity level 1108(*c*) that is lower than that of the received stimuli, i.e. a velocity level of 98. Since the audio samples selected in response to musical stimuli 1102(*a*)-(*c*) correspond to alternating velocity levels of 99, 100, and 98 in this example, an alternating pattern of velocity levels can be created. In such embodiments, audio samples selected in response to subsequent instances of the musical stimulus can be chosen in accordance with the alternating pattern (e.g., 99, 100, 98, 99, 100, 98). In various embodiments, any suitable pattern of velocity levels can be created in response to repeated musical stimuli. Moreover, as described above, a volume level matching can be performed prior to playing back an audio sample corresponding to a velocity level lower or higher than that of the received musical stimuli.

In FIG. 12, an arrangement 1200 is illustrated that includes two musical stimuli, 1202(*a*) and 1202(*b*). In particular, as illustrated in FIG. 12, musical stimulus 1202(*a*) corresponds to a first instance of a C♯ note being played on a guitar with a velocity level 1204(*a*) of 99, and musical stimulus 1202(*b*) corresponds to a second repeated instance of the C♯ note being played on the guitar with a velocity level 1204(*b*) of 99. As further depicted in FIG. 12, musical stimuli 1202(*a*) and 1202(*b*) are positioned four beats apart in arrangement 1200. FIG. 12 also depicts playback map 1206 which illustrates the velocity level of audio samples that may be selected in response to the repeated musical stimuli according to some embodiments. It should be noted that playback map 1206 is provided for purposes of discussion and that, in various embodiments of the invention, a computing device may or may not incorporate such a playback map.

In response to the first instance of the musical stimulus, the computing device can select an audio sample corresponding to the velocity level of the musical stimuli. As shown in playback map 1206, in response to musical stimulus 1202(*a*), the computing device can select and playback an audio sample that corresponds to the same guitar note (e.g., C♯) and the same velocity level 1206(*a*), i.e. a velocity level of 99.

In some embodiments, the time interval between the first and second instances of a musical stimulus can be considered in determining whether to select an audio sample corresponding to different velocity level in response to a second instance of the musical stimulus. Thus, in response to the second instance of the musical stimulus 1202(*b*), the computing device can measure or otherwise determine the time interval between the first and second stimuli (e.g., four beats). The time interval can then be compared to a threshold time interval. In some embodiments, if the measured time interval is greater than (or equal to) the threshold time interval, the computing device may not select an audio sample corresponding to a different velocity level to playback in response to the second instance of the stimulus. For instance, as shown in playback map 1206, in response to musical stimulus 1202(*b*) being positioned four beats apart from musical stimulus 1202(*a*), the computing device may select and playback an audio sample that corresponds to the same guitar note (e.g., C♯) and the same velocity level 1206(*b*), i.e. a velocity level of 99, as that associated with the received stimuli. Thus, the same audio sample can be played back in response to both musical stimuli 1202(*a*) and 1202(*b*) when the time interval between the stimuli meets or exceeds a threshold time interval.

In some embodiments, the computing device may further determine whether repeated instances of a musical stimulus are consecutive. For instance, in an arrangement including musical stimuli that correspond to other instruments (or components of the same instrument), and that are positioned between repeated instances of the musical stimulus, in some embodiments, the computing device may not select an audio sample corresponding to a different velocity level to playback in response to the second instance of the stimulus. Further, in some embodiments, if two or more musical stimuli are received that correspond to different velocity levels, the computing device may select audio samples corresponding to velocity levels that are the same as that of the received musical stimuli.

Figure 13:
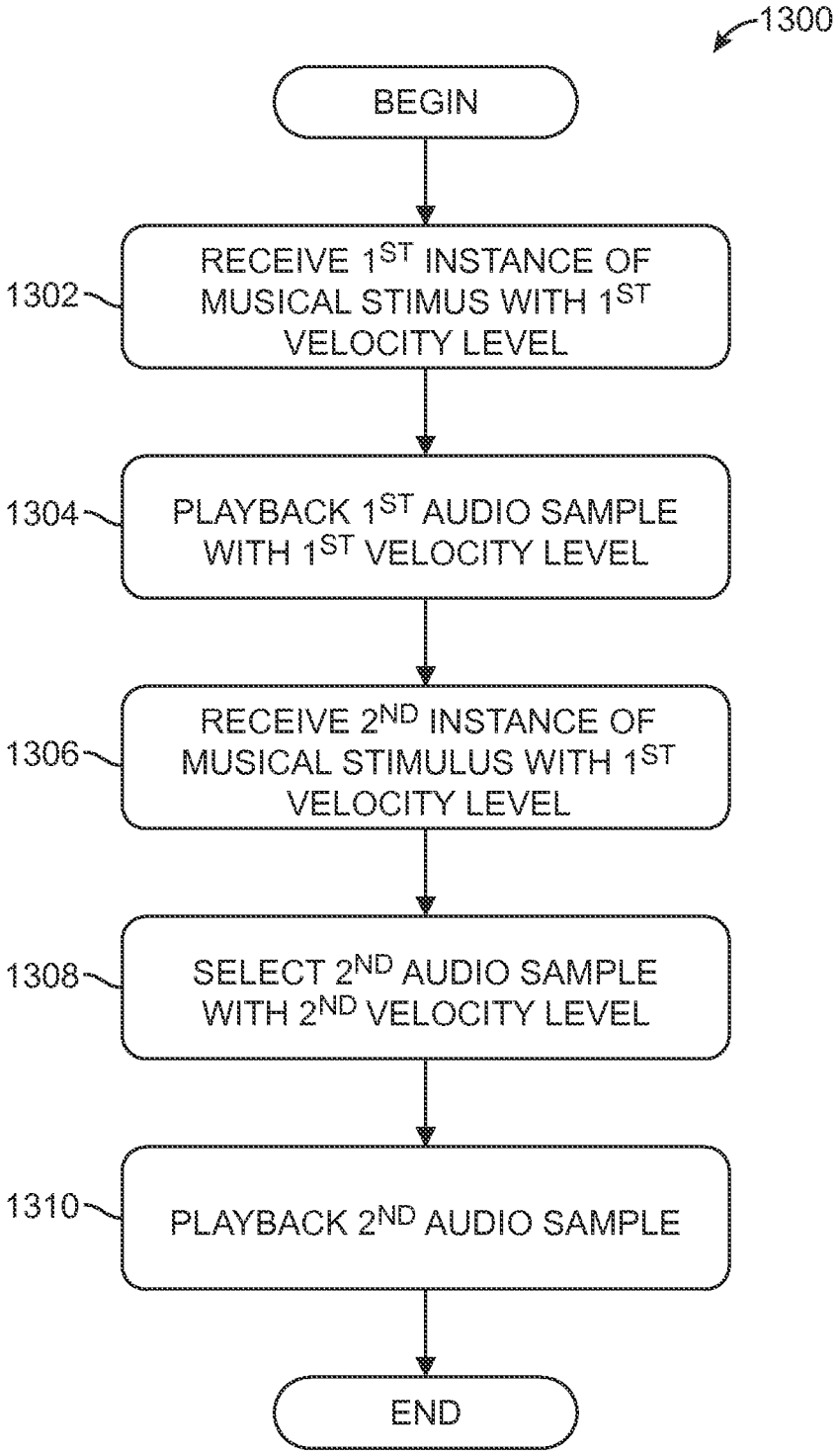
FIG. 13 illustrates a simplified flowchart depicting a method of selecting audio samples having different velocity levels in response to repeated musical stimuli according to some embodiments.

FIG. 13 illustrates a simplified flowchart depicting a method of selecting audio samples having different velocity levels in response to repeated musical stimuli according to some embodiments. The processing depicted in FIG. 13 may be implemented in software (e.g., code, instructions, and/or a program) executed by one or more processors, hardware, or combinations thereof. The software may be stored on a non-transitory computer-readable storage medium (e.g., as a computer-program product). The particular series of processing steps depicted in FIG. 13 are not intended to be limiting.

As illustrated in FIG. 13, at step 1302, a first instance of a musical stimulus having a first velocity level can be received by a computing device. In various embodiments, the musical stimulus can correspond to any suitable musical instrument. In some embodiments, the musical stimulus may be received in the context of a stored arrangement including a plurality of stimuli, and may also be received from an external controller (e.g., a MIDI keyboard). In some embodiments, the musical stimulus can be received in the context of a live musical performance.

At step 1304, a first audio sample corresponding to the first velocity level of the received musical stimulus can be played back. In some embodiments, the first audio sample can be one or a plurality of audio samples that correspond to different velocity levels of the musical stimulus.

At step 1306, a second instance of the musical stimulus having the first velocity level can be received and, at step 1308, a second audio sample corresponding to a second velocity level of the received musical stimulus can be selected from the plurality of audio samples. In some embodiments, the first and second velocity levels can be adjacent velocity levels. In some embodiments, a time interval between the first and second instances of the musical stimulus can be measured and compared to a threshold time interval. In such embodiments, the measured time interval can be determined to be within the threshold time interval prior to selecting the second audio sample corresponding to the second velocity level. In some embodiments, the first and second instances of the musical stimulus can be determined to have been received consecutively prior selecting the second audio sample corresponding to the second velocity level.

At step 1310, the second audio sample can be played back. In some embodiments, the second audio sample may include different audio characteristics than the first audio sample. For instance, the first and second audio samples may have different tonal, timbral, and/or other characteristics. In some embodiments, the first velocity level can correspond to a first volume level and the second velocity level can correspond to a second volume level. In such embodiments, playing back the second audio sample can include modifying the second volume level. In some embodiments, modifying the second volume level can include scaling the second volume level in accordance with the first volume level.

Audio samples corresponding to different velocity levels may include differences in tone, timbre, or other audio characteristics. Thus, by selecting audio samples for playback with different velocity levels, variations can be introduced into an arrangement or performance in which repeated notes are played. Such variation may provide for a more natural sounding and realistic simulation of a live performance using a real musical instrument.

Figure 15:
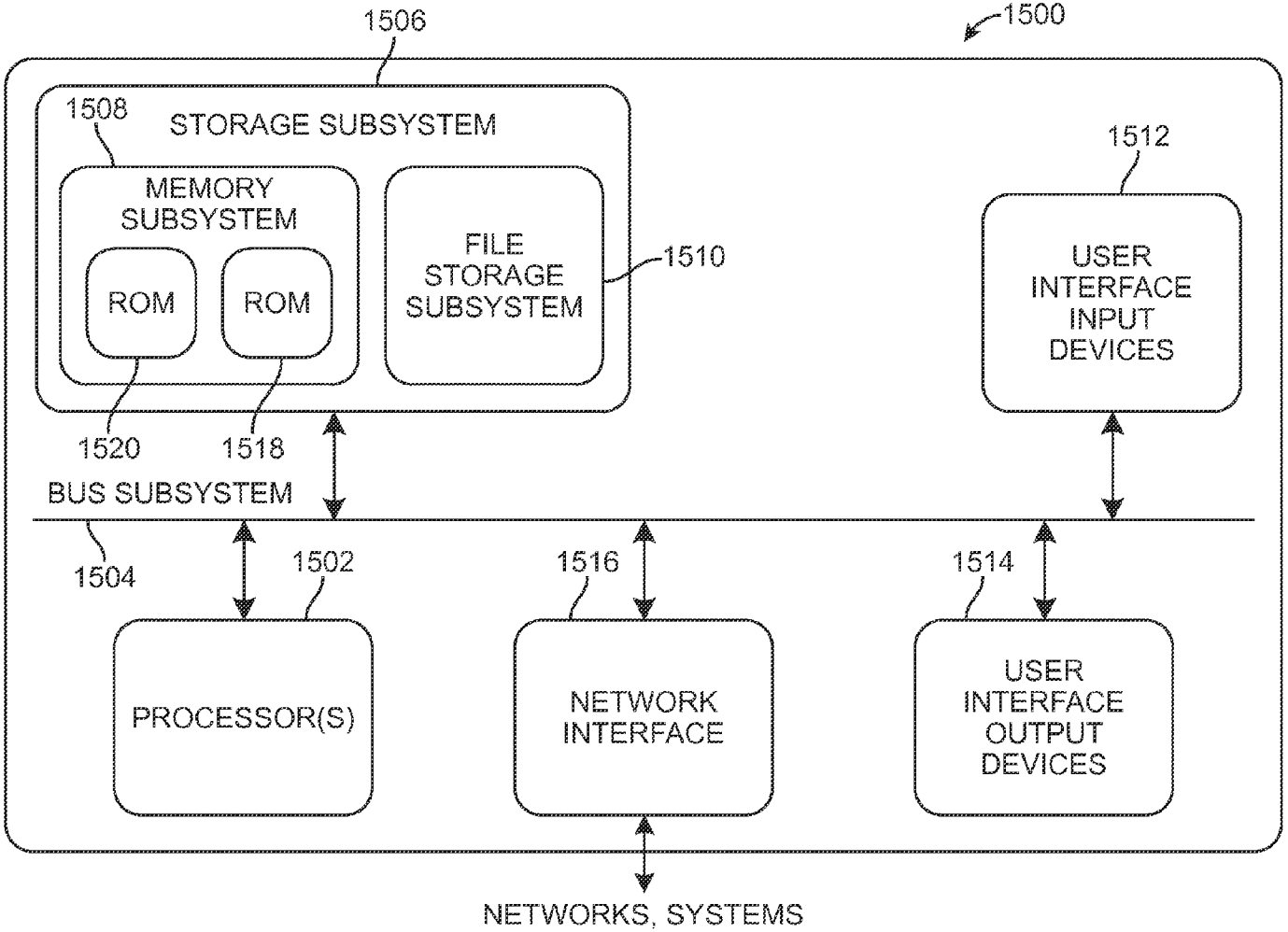
FIG. 15 illustrates a simplified block diagram of a computer system that may incorporate components of a system for selecting audio samples in response to musical stimuli according to some embodiments.

As described above, system 100 illustrated in FIG. 1 may incorporate embodiments of the invention. For instance, system 100 may provide for the selection of an audio sample based on the excitation state of an instrument as illustrated in FIGS. 2-8, and may further provide for the selection of audio samples having different velocity levels in response to repeated musical stimuli as illustrated in FIGS. 10-12. System 100 may further perform one or more of the method steps described above with respect to FIGS. 9 and 13. Moreover, system 100 may be incorporated into various systems and devices. For instance, FIG. 15 illustrates a simplified block diagram of a computer system 1500 that may incorporate components of a system for selecting audio samples in response to musical stimuli in some embodiments. In some embodiments, a computing device can incorporate some or all the components of computer system 1500. As shown in FIG. 15, computer system 1500 may include one or more processors 1502 that communicate with a number of peripheral subsystems via a bus subsystem 1504. These peripheral subsystems may include a storage subsystem 1506, including a memory subsystem 1508 and a file storage subsystem 1510, user interface input devices 1512, user interface output devices 1514, and a network interface subsystem 1516.

Bus subsystem 1504 can provide a mechanism for allowing the various components and subsystems of computer system 1500 communicate with each other as intended. Although bus subsystem 1504 is shown schematically as a single bus, alternative embodiments of the bus subsystem may utilize multiple busses.

Processor 1502, which can be implemented as one or more integrated circuits (e.g., a conventional microprocessor or microcontroller), controls the operation of computer system 1500. One or more processors 1502 may be provided. These processors may include single core or multicore processors. In various embodiments, processor 1502 can execute a variety of programs in response to program code and can maintain multiple concurrently executing programs or processes. At any given time, some or all of the program code to be executed can be resident in processor(s) 1502 and/or in storage subsystem 1506. Through suitable programming, processor(s) 1502 can provide various functionalities described above.

Network interface subsystem 1516 provides an interface to other computer systems and networks. Network interface subsystem 1516 serves as an interface for receiving data from and transmitting data to other systems from computer system 1500. For example, network interface subsystem 1516 may enable computer system 1500 to connect to one or more devices via the Internet. In some embodiments network interface 1516 can include radio frequency (RF) transceiver components for accessing wireless voice and/or data networks (e.g., using cellular telephone technology, advanced data network technology such as 3G, 4G or EDGE, WiFi (IEEE 802.11 family standards, or other mobile communication technologies, or any combination thereof), GPS receiver components, and/or other components. In some embodiments network interface 1516 can provide wired network connectivity (e.g., Ethernet) in addition to or instead of a wireless interface.

User interface input devices 1512 may include a keyboard, pointing devices such as a mouse or trackball, a touchpad or touch screen incorporated into a display, a scroll wheel, a click wheel, a dial, a button, a switch, a keypad, audio input devices such as voice recognition systems, microphones, eye gaze systems, and other types of input devices. In general, use of the term "input device" is intended to include all possible types of devices and mechanisms for inputting information to computer system 1500. For example, in an iPhone®, user input devices 1512 may include one or more buttons provided by the iPhone® and a touchscreen which may display a software keyboard, and the like.

User interface output devices 1514 may include a display subsystem, indicator lights, or non-visual displays such as audio output devices, etc. The display subsystem may be a cathode ray tube (CRT), a flat-panel device such as a liquid crystal display (LCD), a projection device, a touch screen, and the like. In general, use of the term "output device" is intended to include all possible types of devices and mechanisms for outputting information from computer system 1500. For example, a software keyboard may be displayed using a flat-panel screen.

Storage subsystem 1506 provides a computer-readable storage medium for storing the basic programming and data constructs that provide the functionality of some embodiments. Storage subsystem 1506 can be implemented, e.g., using disk, flash memory, or any other storage media in any combination, and can include volatile and/or non-volatile storage as desired. Software (programs, code modules, instructions) that when executed by a processor provide the functionality described above may be stored in storage subsystem 1506. These software modules or instructions may be executed by processor(s) 1502. Storage subsystem 1506 may also provide a repository for storing data used in accordance with the present invention. Storage subsystem 1506 may include memory subsystem 1508 and file/disk storage subsystem 1510.

Memory subsystem 1508 may include a number of memories including a main random access memory (RAM) 1518 for storage of instructions and data during program execution and a read only memory (ROM) 1520 in which fixed instructions are stored. File storage subsystem 1510 may provide persistent (non-volatile) memory storage for program and data files, and may include a hard disk drive, a floppy disk drive along with associated removable media, a Compact Disk Read Only Memory (CD-ROM) drive, an optical drive, removable media cartridges, and other like memory storage media.

Computer system 1500 can be of various types including a personal computer, a portable device (e.g., an iPhone®, an iPad®, and the like), a workstation, a network computer, a mainframe, a kiosk, a server or any other data processing system. Due to the ever-changing nature of computers and networks, the description of computer system 1500 depicted in FIG. 15 is intended only as a specific example. Many other configurations having more or fewer components than the system depicted in FIG. 15 are possible.

Embodiments can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a non-transitory computer-readable medium for execution by, or to control the operation of, data processing apparatus.

Various embodiments described above can be realized using any combination of dedicated components and/or programmable processors and/or other programmable devices. The various embodiments may be implemented only in hardware, or only in software, or using combinations thereof. The various processes described herein can be implemented on the same processor or different processors in any combination. Accordingly, where components or modules are described as being configured to perform certain operations, such configuration can be accomplished, e.g., by designing electronic circuits to perform the operation, by programming programmable electronic circuits (such as microprocessors) to perform the operation, or any combination thereof. Processes can communicate using a variety of techniques including but not limited to conventional techniques for interprocess communication, and different pairs of processes may use different techniques, or the same pair of processes may use different techniques at different times. Further, while the embodiments described above may make reference to specific hardware and software components, those skilled in the art will appreciate that different combinations of hardware and/or software components may also be used and that particular operations described as being implemented in hardware might also be implemented in software or vice versa.

The various embodiments are not restricted to operation within certain specific data processing environments, but are free to operate within a plurality of data processing environments. Additionally, although embodiments have been described using a particular series of transactions, this is not intended to be limiting.

Thus, although specific invention embodiments have been described, these are not intended to be limiting. Various modifications and equivalents are within the scope of the following claims.

What is claimed is:

1. A computer-implemented method, comprising:

receiving, by a computing device, a musical stimulus;

calculating a current excitation level associated with previously received musical stimuli;

selecting an audio sample corresponding to the received musical stimulus, wherein the audio sample is selected using the current excitation level associated with the previously received musical stimuli; and playing back the selected audio sample.

2. The method of claim 1, wherein the selected audio sample is one of a plurality of audio samples corresponding to the received musical stimulus, and wherein the plurality of audio samples correspond to different excitation levels.

3. The method of claim 2, further comprising:

determining a velocity level of the received musical stimulus, wherein the plurality of audio samples correspond to the determined velocity level.

4. The method of claim 2, further comprising:

comparing the current excitation level with threshold levels assigned to the plurality of audio samples, wherein selecting the audio sample includes determining that the current excitation level exceeds a threshold level assigned to the selected audio sample.

5. The method of claim 1, wherein calculating the excitation level comprises:

determining individual excitation levels associated with the previously received musical stimuli; and summing the individual excitation levels to generate the current excitation level.

6. The method of claim 1, wherein the musical stimulus corresponds to a musical instrument that produces a decaying audio pattern.

7. The method of claim 5, wherein the individual excitation levels are determined based upon individual volume levels of the previously received musical stimuli.

8. The method of claim 1, wherein the musical stimulus is a first musical stimulus, wherein the selected audio sample is a first audio sample, and wherein the method further comprises:

identifying the first musical stimulus as a previously received musical stimulus;

receiving a second musical stimulus;

calculating a current excitation level associated with the previously received musical stimuli including the first musical stimulus;

selecting a second audio sample corresponding to the received second musical stimulus, wherein the second audio sample is selected using the current excitation level associated with the previously received musical stimuli including the first musical stimulus; and playing back the selected second audio sample.

9. The method of claim 8, wherein the second audio sample corresponds to a different excitation level than the first audio sample.

10. The method of claim 8, further comprising:

ending the playback of the first audio sample when the playback of the second audio sample is initiated.

11. A computer-implemented system, comprising:

one or more data processors; and one or more non-transitory computer-readable storage media containing instructions configured to cause the one or more processors to perform operations including:

receiving a musical stimulus;

calculating a current excitation level associated with previously received musical stimuli;

selecting an audio sample corresponding to the received musical stimulus, wherein the audio sample is selected using the current excitation level associated with the previously received musical stimuli; and playing back the selected audio sample.

12. The system of claim 11, wherein the selected audio sample is one of a plurality of audio samples corresponding to the received musical stimulus, and wherein the plurality of audio samples correspond to different excitation levels.

13. The system of claim 12, wherein the operations further include:

determining a velocity level of the received musical stimulus, wherein the plurality of audio samples correspond to the determined velocity level.

14. The system of claim 12, wherein the operations further include:

comparing the current excitation level with threshold levels assigned to the plurality of audio samples, wherein selecting the audio sample includes determining that the current excitation level exceeds a threshold level assigned to the selected audio sample.

15. The system of claim 11, wherein calculating the excitation level comprises:

determining individual excitation levels associated with the previously received musical stimuli; and summing the individual excitation levels to generate the current excitation level.

16. The system of claim 11, wherein the musical stimulus corresponds to a musical instrument that produces a decaying audio pattern.

17. The system of claim 15, wherein the individual excitation levels are determined based upon individual volume levels of the previously received musical stimuli.

18. The system of claim 11, wherein the musical stimulus is a first musical stimulus, wherein the selected audio sample is a first audio sample, and wherein the operations further include:

identifying the first musical stimulus as a previously received musical stimulus;

receiving a second musical stimulus;

calculating a current excitation level associated with the previously received musical stimuli including the first musical stimulus;

selecting a second audio sample corresponding to the received second musical stimulus, wherein the second audio sample is selected using the current excitation level associated with the previously received musical stimuli including the first musical stimulus; and playing back the selected second audio sample.

19. The system of claim 18, wherein the second audio sample corresponds to a different excitation level than the first audio sample.

20. The system of claim 18, wherein the operations further include:

ending the playback of the first audio sample when the playback of the second audio sample is initiated.

21. A computer-program product, tangibly embodied in a non-transitory machine-readable storage medium, including instructions configured to cause a data processing apparatus to:

receive a musical stimulus;

calculate a current excitation level associated with previously received musical stimuli;

select an audio sample corresponding to the received musical stimulus, wherein the audio sample is selected using the current excitation level associated with the previously received musical stimuli; and playback the selected audio sample.

22. The computer-program product of claim 21, wherein the selected audio sample is one of a plurality of audio samples corresponding to the received musical stimulus, and wherein the plurality of audio samples correspond to different excitation levels.

23. The computer-program product of claim 22, wherein the instructions are further configured to cause the data processing apparatus to:

determine a velocity level of the received musical stimulus, wherein the plurality of audio samples correspond to the determined velocity level.

24. The computer-program product of claim 22, wherein the instructions are further configured to cause the data processing apparatus to:

compare the current excitation level with threshold levels assigned to the plurality of audio samples, wherein selecting the audio sample includes determining that the current excitation level exceeds a threshold level assigned to the selected audio sample.

25. The computer-program product of claim 21, wherein calculating the excitation level comprises:

determining individual excitation levels associated with the previously received musical stimuli; and summing the individual excitation levels to generate the current excitation level.

26. The computer-program product of claim 21, wherein the musical stimulus corresponds to a musical instrument that produces a decaying audio pattern.

27. The computer-program product of claim 25, wherein the individual excitation levels are determined based upon individual volume levels of the previously received musical stimuli.

28. The computer-program product of claim 21, wherein the musical stimulus is a first musical stimulus, wherein the selected audio sample is a first audio sample, and wherein the instructions are further configured to cause the data processing apparatus to:

identify the first musical stimulus as a previously received musical stimulus;

receive a second musical stimulus;

calculate a current excitation level associated with the previously received musical stimuli including the first musical stimulus;

select a second audio sample corresponding to the received second musical stimulus, wherein the second audio sample is selected using the current excitation level associated with the previously received musical stimuli including the first musical stimulus; and playback the selected second audio sample.

29. The computer-program product of claim 28, wherein the second audio sample corresponds to a different excitation level than the first audio sample.

30. The computer-program product of claim 28, wherein the instructions are further configured to cause the data processing apparatus to:

end the playback of the first audio sample when the playback of the second audio sample is initiated.

* * * * *